US008514239B2

(12) United States Patent
Miyahara

(10) Patent No.: US 8,514,239 B2
(45) Date of Patent: Aug. 20, 2013

(54) IMAGE PROCESSING APPARATUS, IMAGE PROCESSING METHOD, AND COMPUTER PROGRAM PRODUCT

(75) Inventor: Seiji Miyahara, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 256 days.

(21) Appl. No.: 12/801,506

(22) Filed: Jun. 11, 2010

(65) Prior Publication Data

US 2010/0321400 A1 Dec. 23, 2010

(30) Foreign Application Priority Data

Jun. 17, 2009 (JP) ..... 2009-143814
May 11, 2010 (JP) ..... 2010-109636

(51) Int. Cl.
*G09G 5/02* (2006.01)

(52) U.S. Cl.
USPC ..... 345/590; 345/589; 345/591; 345/600; 345/601; 345/604; 382/114; 382/167

(58) Field of Classification Search
None
See application file for complete search history.

(56) References Cited

U.S. PATENT DOCUMENTS 5,677,741 A * 10/1997 Yui ..... 348/649
7,394,468 B2 * 7/2008 Hofman et al. ..... 345/589

FOREIGN PATENT DOCUMENTS

JP 4155051 B2 2/2004
JP 3867988 B2 6/2006
JP 2006-246072 A 9/2006
JP 2006-350066 A 12/2006
JP 2007-334053 A 12/2007

OTHER PUBLICATIONS

Okabe et al., "Barrier-free presentation method that is friendly to colorblind people," Nov. 20, 2002. http://jfly.iam.u-tokyo.ac.jp/color/ (English) and http://www.nig.ac.jp/color/gen/index.html (Japanese).
English language abstract of JP-2004-246739 published Sep. 2, 2004.
English language abstract of JP-2006-157301 published Jun. 15, 2006.

* cited by examiner

*Primary Examiner* — Antonio A Caschera
(74) *Attorney, Agent, or Firm* — Harness, Dickey & Pierce P.L.C.

(57) ABSTRACT

An image processing apparatus includes a color converting unit that converts input image data into image forming data used for image formation; and a control unit that controls the image formation by the image forming data, wherein the color converting unit converts each of a plurality of predetermined colors that are difficult for colorblind people to mutually distinguish among colors included in a color space of the input image data, as difficult colors for colorblind people, into a same color in a color space of the image forming data.

35 Claims, 16 Drawing Sheets

FIG. 17

```
...
...
C100:Font{1}
C101:FontSize{10}
CC102:FontColor{0,0,0}
103:Position{50,100}
C104:String{SampleGraph}
...
...
C301:FillColor{128,230,211}
C302:RectFill{50,100,20,20}
```

<DRAWING INSTRUCTION PART FOR TEXT>

<DRAWING INSTRUCTION PART FOR RECTANGLE>

FIG. 18

<BEFORE ADJUSTMENT>

```
C100:Font{1}
C101:FontSize{15}
C102:FontColor{133,88,143}
C103:Position{50,100}
C104:String{SampleGraph}
...
...
C301:FillColor{65,152,175}
C302:RectFill{50,100,15,15}
```

<AFTER ADJUSTMENT>

```
C100:Font{1}
C101:FontSize{15}
C102:FontColor{62,37,83}
C103:Position{50,100}
C104:String{SampleGraph}
...
...
C301:FillColor{101,185,209}
C302:RectFill{50,100,15,15}
```

FIG. 19A

| NO. | R | G | B | L* | a* | b* | Gr. | Dist. | S. |
|---|---|---|---|---|---|---|---|---|---|
| 1 | 69 | 114 | 167 | 0.00 | 0.00 | 0.00 | 0 | 0 | 0.00 |
| 2 | 170 | 70 | 67 | 0.00 | 0.00 | 0.00 | 0 | 0 | 0.00 |
| 3 | 137 | 165 | 78 | 0.00 | 0.00 | 0.00 | 0 | 0 | 0.00 |
| 4 | 113 | 88 | 143 | 0.00 | 0.00 | 0.00 | 0 | 0 | 0.00 |
| 5 | 65 | 152 | 175 | 0.00 | 0.00 | 0.00 | 0 | 0 | 0.00 |
| 6 | 219 | 132 | 61 | 0.00 | 0.00 | 0.00 | 0 | 0 | 0.00 |

FIG. 19B

| NO. | R | G | B | L* | a* | b* | Gr. | Dist. | S. |
|---|---|---|---|---|---|---|---|---|---|
| 1 | 69 | 114 | 167 | 0.00 | 0.00 | 0.00 | 0 | 0 | 100 |
| 2 | 170 | 70 | 67 | 0.00 | 0.00 | 0.00 | 0 | 0 | 225 |
| 3 | 137 | 165 | 78 | 0.00 | 0.00 | 0.00 | 0 | 0 | 225 |
| 4 | 113 | 88 | 143 | 0.00 | 0.00 | 0.00 | 0 | 0 | 225 |
| 5 | 65 | 152 | 175 | 0.00 | 0.00 | 0.00 | 0 | 0 | 225 |
| 6 | 219 | 132 | 61 | 0.00 | 0.00 | 0.00 | 0 | 0 | 225 |

FIG. 20A

| NO. | R | G | B | L* | a* | b* | Gr. | Dist. | S. |
|---|---|---|---|---|---|---|---|---|---|
| 1 | 69 | 114 | 167 | 47.09 | 0.91 | −33.08 | 0 | 0 | 100 |
| 2 | 170 | 70 | 67 | 43.26 | 40.89 | 22.66 | 0 | 0 | 225 |
| 3 | 137 | 165 | 78 | 63.98 | −23.75 | 41.45 | 0 | 0 | 225 |
| 4 | 113 | 88 | 143 | 41.96 | 21.92 | −26.63 | 0 | 0 | 225 |
| 5 | 65 | 152 | 175 | 58.67 | −18.89 | −19.78 | 0 | 0 | 225 |
| 6 | 219 | 132 | 61 | 63.26 | 27.70 | 51.00 | 0 | 0 | 225 |

FIG. 20B

| NO. | R | G | B | L* | a* | b* | Gr. | Dist. | S. |
|---|---|---|---|---|---|---|---|---|---|
| 1 | 69 | 114 | 167 | 47.09 | 0.91 | −33.08 | 1 | 0.74 | 100 |
| 2 | 170 | 70 | 67 | 43.26 | 40.89 | 22.66 | 2 | 5.81 | 225 |
| 3 | 137 | 165 | 78 | 63.98 | −23.75 | 41.45 | 2 | ··· | 225 |
| 4 | 113 | 88 | 143 | 41.96 | 21.92 | −26.63 | 1 | ··· | 225 |
| 5 | 65 | 152 | 175 | 58.67 | −18.89 | −19.78 | 1 | ··· | 225 |
| 6 | 219 | 132 | 61 | 63.26 | 27.70 | 51.00 | 2 | ··· | 225 |

FIG. 21A

| NO. | R | G | B | L* | a* | b* | Gr. | Dist. | S. |
|---|---|---|---|---|---|---|---|---|---|
| 1 | 69 | 114 | 167 | 47.09 | 0.91 | −33.08 | 1 | 2.5 | 100 |
| 2 | 170 | 70 | 67 | 43.26 | 40.89 | 22.66 | 2 | 5.809 | 225 |
| 3 | 137 | 165 | 78 | 63.98 | −23.75 | 41.45 | 2 | ··· | 225 |
| 4 | 113 | 88 | 143 | 20.00 | 21.92 | −23.85 | 1 | ··· | 225 |
| 5 | 65 | 152 | 175 | 70.87 | −18.89 | −19.78 | 1 | ··· | 225 |
| 6 | 219 | 132 | 61 | 63.26 | 27.70 | 51.00 | 2 | ··· | 225 |

FIG. 21B

| NO. | R | G | B | R' | G' | B' |
|---|---|---|---|---|---|---|
| 1 | 69 | 114 | 167 | 69 | 114 | 167 |
| 2 | 170 | 70 | 67 | 170 | 70 | 67 |
| 3 | 137 | 165 | 78 | 137 | 165 | 78 |
| 4 | 113 | 88 | 143 | 62 | 37 | 83 |
| 5 | 65 | 152 | 175 | 101 | 185 | 209 |
| 6 | 219 | 132 | 61 | 219 | 132 | 61 |

IMAGE PROCESSING APPARATUS, IMAGE PROCESSING METHOD, AND COMPUTER PROGRAM PRODUCT

CROSS-REFERENCE TO RELATED APPLICATIONS

The present application claims priority to and incorporates by reference the entire contents of Japanese Patent Application No. 2009-143814 filed in Japan on Jun. 17, 2009 and Japanese Patent Application No. 2010-109636 filed in Japan on May 11, 2010.

BACKGROUND OF THE INVENTION

1. Field of the Invention

The present invention relates to an image processing apparatus, an image processing method, and a computer program product.

2. Description of the Related Art

In recent years, various colored characters and color images are used in a document created by individuals or companies along with the development of a color image output technology such as display or printing of a color image. In such a document, a color itself is often given important information, such as performing color-coding by colored characters or a plurality of colors for a sign to draw attention or grouping of a graph. Therefore, in order to correctly understand these contents of the document, it is required to have an ability to distinguish a difference of colors used in the document in addition to an ability to recognize characters and images.

A document, in which such various colors are used, is easily understood by people having a common color vision; however, the same is not always true for people having a color vision property different from the common color vision. According to a physiological and medical research on a human color vision, it is ever known that some types exist as the color vision property such as red-green blindness with which red and green are difficult to distinguish or cannot distinguish, yellow-blue blindness, and total color-blindness. Recently, the CUDO (NPO Color Universal Design Organization) advocates to describe people having a C-type (initial letter of Common) color vision as a common color vision and describe other people having a weak portion in recognizing color as colorblind people by using type names of the color vision such as the C-type instead of drawing a line by whether the color vision is normal or abnormal. The types of the color vision include strong and weak P-types (Protanope) (corresponding to red-green blindness or colorblind), strong and weak D-types (Deuteranope) (corresponding to red-green blindness or colorblind), a T-type (Tritanope) (corresponding to yellow-blue blindness), and an A-type (Achromat) (corresponding to total color-blindness) other than the C-type.

Conventionally, a load for document creation for people having such various color vision properties to easily distinguish colors becomes extremely large and a degree of latitude in design is limited in some cases. For example, a typical situation is assumed, in which the common color vision people create an electronic document for presentation, which is color-printed and distributed, and the electronic document is projected on a screen to make the presentation. In this case, for example, in a typical office application software for creating a graph, a color scheme is automatically applied to each element, so that a user needs to designate a color for each element again in some cases.

Moreover, typically, a color range to be reproduced becomes different between different image output apparatuses such as a printing apparatus including a color printer and a projector that projects an image on a screen. Therefore, even if the color scheme is applied so that a color difference can be easily recognized on a printing, the colors sometimes change on a projected image, so that distinction of the colors is not improved in some cases.

For solving such a problem, a color-sample selecting apparatus is proposed that facilitates the common color vision people who make a document to select a color that is not easily confused by the colorblind people at the time the document made by controlling such that a color easily confused by the colorblind people cannot be selected. Moreover, a display system is proposed that displays an image simulating a view of the colorblind people so that the common color vision people can recognize a portion that is difficult to distinguish for the colorblind people.

For example, Japanese Patent Application Laid-open No. 2006-350066 discloses a color-sample selecting apparatus that, when a color to be used in a document or a design is selected, controls not to select a combination of a color that could easily confuse the colorblind people. Moreover, Japanese Patent Application Laid-open No. 2007-334053 discloses a display system that displays an image simulating a view that the colorblind people see, for causing the common color vision people to recognize a difficulty of distinguishing colors for the colorblind people.

However, even the methods, such as those disclosed in Japanese Patent Application Laid-open No. 2006-350066 and Japanese Patent Application Laid-open No. 2007-334053, have problems that it is difficult for the common color vision people to determine whether the colorblind people can distinguish, and a load for document creation cannot be improved in some cases. For example, the display system, such as disclosed in Japanese Patent Application Laid-open No. 2007-334053, displays a color vision simulation image. However, it is known that a hue is different depending on a simulation rule and the color vision property is individually different even among the common color vision people. Therefore, when a color is slightly different in the result of the color vision simulation, in some cases the common color vision people are difficult to determine whether it is difficult for the colorblind people to distinguish the color difference. Moreover, when the common color vision people determine that it is difficult for the colorblind people to distinguish the color difference, problems arise, such as limitation in design and a trouble of changing the color scheme, i.e., avoiding use of a color that is difficult for the colorblind people to distinguish or replacing with a different color.

SUMMARY OF THE INVENTION

It is an object of the present invention to at least partially solve the problems in the conventional technology.

According to an aspect of the present invention, there is provided an image processing apparatus including: a color converting unit that converts input image data into image forming data used for image formation; and a control unit that controls the image formation by the image forming data, wherein the color converting unit converts each of a plurality of predetermined colors that are difficult for colorblind people to mutually distinguish among colors included in a color space of the input image data, as difficult colors for colorblind people, into a same color in a color space of the image forming data.

According to another aspect of the present invention, there is provided an image processing method including: color-converting that converts input image data into image forming data used for image formation; and controlling the image formation by the image forming data, wherein the color-converting includes converting each of a plurality of predetermined colors that are difficult for colorblind people to mutually distinguish among colors included in a color space of the input image data, as difficult colors for colorblind people, into a same color in a color space of the image forming data.

According to still another aspect of the present invention, there is provided a computer program product including a computer-usable medium having computer-readable program codes embodied in the medium for processing information in an information processing apparatus, the program codes when executed causing a computer to execute; color-converting that converts input image data into image forming data used for image formation; and controlling the image formation by the image forming data, wherein the color-converting includes converting each of a plurality of predetermined colors that are difficult for colorblind people to mutually distinguish among colors included in a color space of the input image data, as difficult colors for colorblind people, into a same color in a color space of the image forming data.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 17 is a diagram illustrating an example of input image data described in PDL;

FIG. 18 is a diagram illustrating an example of image data adjusted by a color adjusting unit;

FIGS. 19A and 19B are respectively diagrams illustrating an example of extracted use color information and an example of use color information to which an area evaluation values is added;

FIGS. 20A and 20B are respectively diagrams illustrating an example of the use color information to which an intermediate color signal is added, and an example of the use color information to which a discrimination evaluation value is added;

FIGS. 21A and 21B are respectively diagrams illustrating an example of the use color information that is color-adjusted and an example of a color adjusting table.

DETAILED DESCRIPTION OF THE PREFERRED EMBODIMENTS

Embodiments of an image processing apparatus, an image processing method, and a computer program product according to this invention are explained in detail below with reference to the accompanying drawings.

An image processing apparatus in a first embodiment replaces colors, which are easily confused by colorblind people, included in input image data with the same color as confused by the colorblind people to output at the time of outputting an image such as by printing. The first embodiment, for example, assumes a case in which a color scheme used in a graph in an office application or the like is identified in advance. Then, an LUT (Look Up Table), which converts confusion colors into the same color, is provided in advance and the confusion colors are converted into the same color by using this LUT.

Moreover, in the first embodiment, notification is issued to urge information compensation by an oral explanation for a portion converted into the same color. Whereby, a load on a document creator, who is to make a presentation or the like based on the document, at the time of document creation dose not increase and a degree of freedom in design is not limited. And at the same time, it is possible to cause the information compensation to be easily performed by a method other than visual information, such as an oral explanation, at the presentation using the created document.

The information compensation by communication is performed by directly pointing with a pointer or the like while covering by communication, so that intension of a presenter is easily understood, which is described in "Barrier-free presentation method that is friendly to colorblind people", Masataka Okabe and Kei Ito (URL: http://www.nig.ac.jp/color/gen/index.html) (see "summary of barrier-free and other notes").

Figure 1:
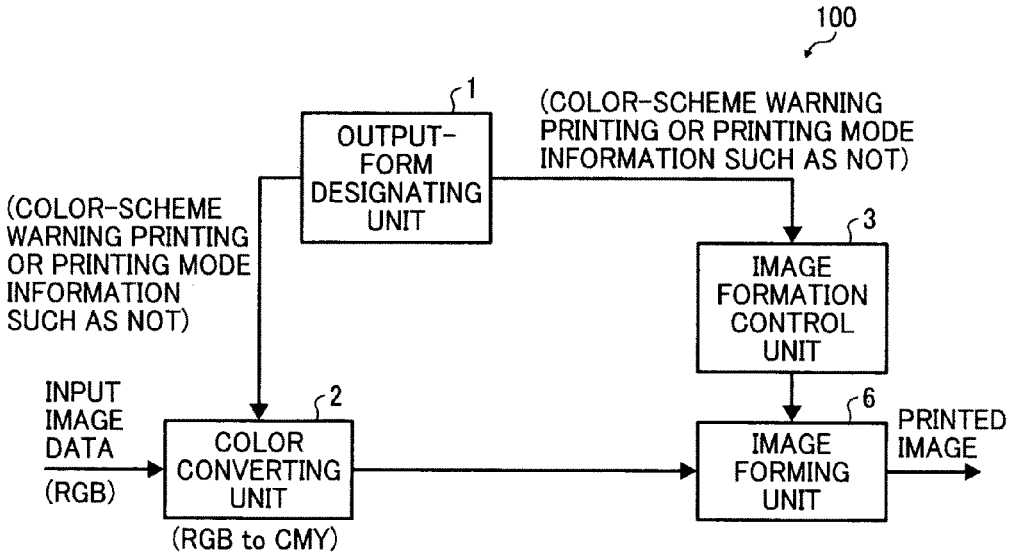
FIG. 1 is a block diagram illustrating a configuration example of an image processing apparatus according to a first embodiment.

FIG. 1 is a block diagram illustrating a configuration example of an image processing apparatus 100 according to the first embodiment. The image processing apparatus 100 can be realized, for example, as an image forming apparatus such as an MFP (Multi Function Peripheral), a printer, a scanner apparatus, and a facsimile apparatus. The image processing apparatus 100 can be applied to any other apparatuses such as a general personal computer so long as it is an apparatus that converts and outputs image data that is input (input image data).

As shown in FIG. 1, the image processing apparatus 100 includes an output-form designating unit 1, a color converting unit 2, an image formation control unit 3, and an image forming unit 6.

The output-form designating unit 1 receives designation of an output form (printing mode) of an image. The output-form designating unit 1, for example, receives the designation by a user using an operation unit (not shown) included in the image processing apparatus 100 or a display device, an input device such as a mouse, and the like of a computer connected to the image processing apparatus 100 via a network or the like. As a printing mode, for example, it is possible to designate a color-scheme warning printing mode that performs a color-scheme warning printing, a general document mode that performs a normal printing, and the like. The color-scheme warning printing mode indicates a mode of replacing colors that are easily confused by the colorblind people with the same color and perform printing. The output-form designating unit 1, for example, sends printing mode information including information indicating whether the mode is the color-scheme warning printing mode to the color converting unit 2 and the image formation control unit 3.

Moreover, when the color-scheme warning printing mode is designated, the output-form designating unit 1 functions as a notifying unit that notifies that colors that are difficult for the colorblind people to distinguish mutually are converted into the same color as the colorblind people recognize. For example, the output-form designating unit 1 displays a message that represents to urge an oral explanation by pointing a portion in which a color difference cannot be recognized on a display device or the like. The notifying method is not limited thereto, and other methods, such as printing of a message on a paper medium, can be applied.

The color converting unit 2 interpolates a conversion table that is prepared in advance and converts the input image data into data (image forming data) used in image formation in accordance with the designated printing mode. The input image data is typically represented in a RGB color space. The image forming data is typically represented in a CMY(K) color space. When the image forming data is displayed on a display device of a computer instead of printing the image forming data, the image forming data is represented in the RGB color space.

The image formation control unit 3 controls the image forming unit 6 to form image so that the image forming data converted by the color converting unit 2 is collectively printed or is printed on both sides in accordance with the designated printing mode.

The image forming unit 6 forms an image on a medium such as a paper or the display device based on the image forming data sent from the color converting unit 2 in accordance with the control by the image formation control unit 3.

Figure 2:
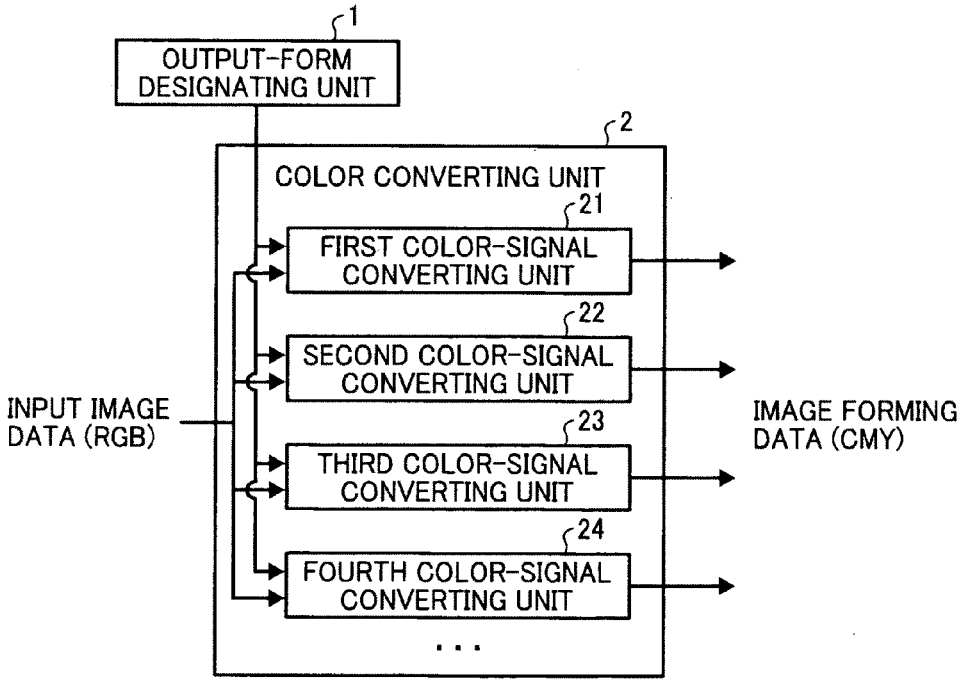
FIG. 2 is a block diagram illustrating a configuration example of a color converting unit in the first embodiment.

FIG. 2 is a block diagram illustrating a configuration example of the color converting unit 2 in the first embodiment. As shown in FIG. 2, the color converting unit 2 includes a first color-signal converting unit 21, a second color-signal converting unit 22, a third color-signal converting unit 23, and a fourth color-signal converting unit 24.

When the color-scheme warning printing mode is designated, the first color-signal converting unit 21, the second color-signal converting unit 22, the third color-signal converting unit 23, and the fourth color-signal converting unit 24 convert the input image data into the image forming data by using different conversion tables (details are described later) that are prepared in advance and correspond to respective color vision properties or the like and send the data after the conversion to the image forming unit 6.

Figure 3:
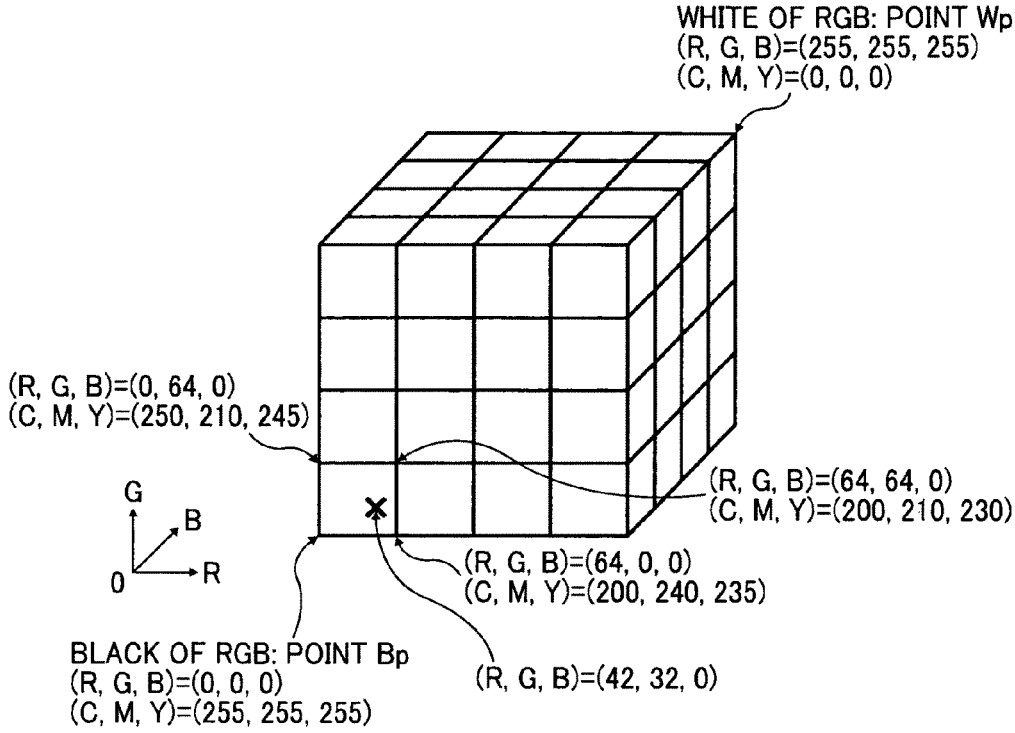
FIG. 3 is a diagram explaining a conversion table.

FIG. 3 is a diagram explaining the conversion table. The color converting unit 2 interpolates the conversion table as shown in FIG. 3 to convert the input image data into the image forming data.

The conversion table shown in FIG. 3 is an example in which each component of the RGB space (RGB takes a value of 0 to 255) of the input image data is separated at four-divided grid points (every 64 grid points). A CMY value of the image forming data corresponding to an RGB value of the input image data is allocated to each grid point. For example, when the input image data having the RGB value (R,G,B)=(42,32,0) in FIG. 3 is converted into the image forming data, the CMY values corresponding to four points (R,G,B)=(0,0,0), (64,0,0), (0,64,0), (64,64,0) are interpolated (weighted averaging) to obtain the CMY value corresponding to the input image data. In this example, because a B component of the input image data is 0, the interpolation with substantially four points is performed; however, typically, the B component exists, so that the interpolation with eight points is performed.

Figure 4:
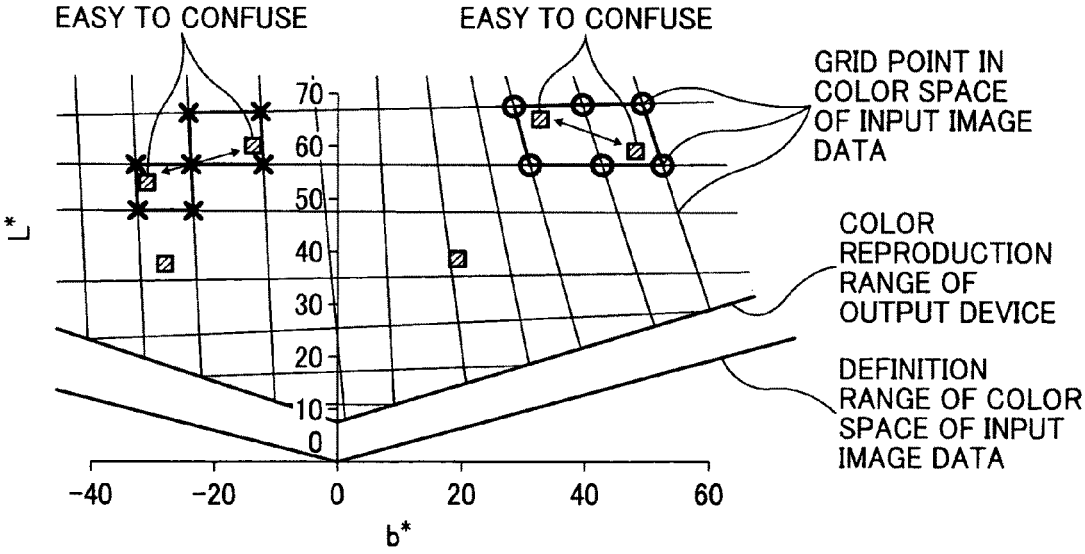
FIG. 4 is a diagram explaining a generating method of the conversion table.

FIG. 4 is a diagram explaining a creating method of the conversion table. A horizontal axis and a vertical axis in FIG. 4 are a b* axis and an L* axis in a CIELAB color space, respectively. A definition range of a color space of the input image data in FIG. 4 is a range of a color that the input image data can take, and typically corresponds to a color reproduction range (for example, sRGB color space) of a liquid crystal display or the like. The color reproduction range of an output device is the color reproduction range of the output device, such as an MFP and a printer, which prints on a paper medium. Typically, the definition range of the color space of the input image data is broader than that of the output device.

The color converting unit 2 divides the color space of the input image data at the grid points as shown in FIG. 3 and converts the RGB value at each grid point into an XYZ tristimulus value by the following Equation (1) to Equation (3).

$$\left.\begin{aligned} R'_{sRGB} &= R_{8bit} \div 255 \\ G'_{sRGB} &= R_{8bit} \div 255 \\ B'_{sRGB} &= R_{8bit} \div 255 \end{aligned}\right\} \tag{1}$$

$$\left.\begin{aligned} &\text{if } R'_{sRGB}, G'_{sRGB}, B'_{sRGB} \le 0.04045 \\ &R_{sRGB} = R'_{sRGB} \div 12.92 \\ &G_{sRGB} = G'_{sRGB} \div 12.92 \\ &B_{sRGB} = B'_{sRGB} \div 12.92 \\ &\text{else } R'_{sRGB}, G'_{sRGB}, B'_{sRGB} > 0.04045 \\ &R_{sRGB} = [(R'_{sRGB} + 0.055)/1.055]^{2.4} \\ &G_{sRGB} = [(G'_{sRGB} + 0.055)/1.055]^{2.4} \\ &B_{sRGB} = [(B'_{sRGB} + 0.055)/1.055]^{2.4} \end{aligned}\right\} \tag{2}$$

$$\begin{bmatrix} X \\ Y \\ Z \end{bmatrix} = \begin{bmatrix} 0.4124 & 0.3576 & 0.1805 \\ 0.2126 & 0.7152 & 0.0722 \\ 0.0193 & 0.1192 & 0.9505 \end{bmatrix} \begin{bmatrix} R_{sRGB} \\ G_{sRGB} \\ B_{sRGB} \end{bmatrix} \tag{3}$$

Moreover, the color converting unit 2 converts the XYZ tristimulus value into an L*a*b* value in accordance with the definition of the CIELAB color space. At this time, the definition range of the color space of the input image data is broader than the color reproduction range of the output device. Therefore, mapping is performed on the color reproduction range (which is determined in advance by outputting color samples corresponding to a plurality of CMY combinations and performing colorimetry or the like) of the output device. For example, the mapping is performed in a direction that minimizes a color difference. The grid points of the space of the input image data in FIG. 4 schematically represent the grid points after performing such mapping.

In the followings, explanation is given for the creating method of the conversion table of each of the signal converting units (the first color-signal converting unit 21, the second color-signal converting unit 22, the third color-signal converting unit 23, and the fourth color-signal converting unit 24) included in the color converting unit 2. The conversion tables of the first color-signal converting unit 21, the second color-signal converting unit 22, the third color-signal converting unit 23, and the fourth color-signal converting unit 24 correspond to the conversion tables corresponding to the color vision properties of common color vision people (C-type color vision), a P-type color vision, a D-type color vision, and a T-type color vision respectively.

(1) Generating Method of Conversion Table of First Color-Signal Converting Unit 21

The CMY value for the image formation of the output device, with which the color difference is minimum, is determined with respect to the L*a*b* value of each grid point after the above mapping. This can be performed, for example, by outputting color samples in which the CMYs are variously combined and performing the colorimetry thereon in advance and selecting the closest one. Or this can be performed by outputting a few number of the color samples and performing the colorimetry thereon, constructing a model for estimating the L*a*b* value to be output from the CMY value, and determining the CMY value with which the color difference becomes minimum based on the model.

With the above process, it is possible to obtain a table in which the RGB value of the input image data is associated with the CMY value for the image formation of the output device. This table is defined as the conversion table of the first color-signal converting unit 21.

It is difficult in some cases even for some common color vision people to distinguish colors depending on the color scheme in a graph or the like. Therefore, it is applicable to generate the conversion table similar to the conversion table that replaces colors that are difficult for the colorblind people to distinguish with the same color. In this case, the color difference between colors is evaluated by a ΔEab or ΔE94 color difference equation of a CIE as a distinction evaluation equation, and evaluation is performed by determining whether the color difference is equal to or leis than a predetermined value (for example, about 13 that is a target of the color difference with which similar colors can be clearly distinguished).

(2) Generating Method of Conversion Table of Second Color-Signal Converting Unit 22 (P-Type Color Vision is Emphatically Simulated)

The L*a*b* Value at Each Grid Point after the Above mapping is restored to the XYZ tristimulus value by an inverse calculation of the definitional equation of the CIELAB color space. Moreover, the XYZ tristimulus value is converted into an LMS value of a cone response space by the following Equation (4). Furthermore, the LMS value is converted into a signal that simulates the cone response of the P-type color vision people by the following Equation (5). Then, the signal is inversely converted into the XYZ tristimulus value by the following Equation (6). Moreover, the XYZ tristimulus value is converted into the L*a*b* value in accordance with the definition of the CIELAB color space.

$$\begin{bmatrix} L \\ M \\ S \end{bmatrix} = \begin{bmatrix} 0.4002 & 0.7016 & -0.0808 \\ -0.2263 & 1.1653 & 0.0457 \\ 0.0 & 0.0 & 0.9182 \end{bmatrix} \begin{bmatrix} X \\ Y \\ Z \end{bmatrix} \tag{4}$$

$$\begin{bmatrix} L_P \\ M_P \\ S_P \end{bmatrix} = \begin{bmatrix} 2.02344M - 2.52581S \\ M \\ S \end{bmatrix} \tag{5}$$

$$\begin{bmatrix} X' \\ Y' \\ Z' \end{bmatrix} = \begin{bmatrix} 0.4002 & 0.7016 & -0.0808 \\ -0.2263 & 1.1653 & 0.0457 \\ 0.0 & 0.0 & 0.9182 \end{bmatrix}^{-1} \begin{bmatrix} L_{PorD} \\ M_{PorD} \\ S_{PorD} \end{bmatrix} \tag{6}$$

The L*a*b* value calculated as a result simulates an amount of perception when the P-type color vision people view a color at a grid point in the color space of the input image data after the mapping. In the similar manner to the above-mentioned, the CMY value, with which the color difference becomes minimum, is calculated with respect to this L*a*b* value simulating the amount of perception of the P-type color vision people to set as the conversion table. The CMY values at part of the grid points on this conversion table are changed as follows.

First, typically, in a document created by an office application (spreadsheet software, Trade-marked) or the like, the color scheme used in a graph is such that predetermined colors are allocated in order according to the number of elements. Moreover, the document is typically made such that a few colors in a color pallet are used for a color character or the like.

High-order colors of the color scheme of a widely-used office application are extracted, and the table (RGB to Lab (P-type)) that converts into the L*a*b* value simulating the amount of perception of the P-type color vision people is used so as to determine the L*a*b* values with respect to the RGB values of the above high-order colors by interpolation. Square-symbol plots (six colors in FIG. 4) in FIG. 4 represent the L*a*b* values determined by such interpolation.

A score of the distinction is calculated by the following Equation (7) for all combinations of these colors. Equation (7) is defied by taking into consideration of the lightness difference κ between a black point in the color space of the input image data and a black point of the output device, in addition to a result of a subjective evaluation experiment for the color distinction.

$$(\text{Dist.}) = 0.3 \times |\Delta L^* - k| + 0.1 \times |\Delta b^*| + 0.01 \times |\Delta a^*| \tag{7}$$

where, ΔL* is an L* component difference between two colors, Δb* is a b* component difference between two colors, Δa* is an a* component difference between two colors, k is a lightness difference between a black point of the input image data and a black point of the output device, and Dist. is a score (distinguishable when the score is three or more) of distinction.

For the value of the lightness difference k, a value is used, which corresponds to the lightness difference of the black points of the color reproduction range of the output device and the definition range of the color space of the input image data in FIG. 4. As described above, when performing the mapping on the color reproduction range of the output device, some cases are considered such as a case of applying a grid point out of the reproduction range onto the reproduction range surface and a case of matching the color reproduction range by scaling down the whole color space; however, normally, the lightness difference by the mapping becomes the lightness difference between the black points thereof at a maximum.

On the other hand, although the effect of the mapping in a saturation direction occurs, the lightness difference significantly contributes to the color distinction as is apparent from coefficients of $\Delta L^*$ and $\Delta b^*$ in Equation (7). Therefore, in the present embodiment, the color distinction is evaluated on the premise that the difference to the degree of the lightness difference between the black points occurs. Whereby, it is possible to suppress that the difference occurs between a combination of colors that are actually difficult to distinguish and a combination of colors that are replaced by the same color by the method of the present embodiment due to the difference between the color space (such as the color space that is projected by a projector) of the input image data and the color reproduction range of the output device.

When there is a combination of colors whose (Dist.) in Equation (7) is less than three, the CMY values corresponding to the grid points used for the interpolation calculation of the colors are replaced so that the average of these grid points or the total of the CMY values is unified to the minimum value. In the example shown in FIG. 4, in the case of the upper-right two colors, six grid points indicated by o correspond to the grid points used for the interpolation calculation. In the case of the upper-left two colors, seven grid points indicated by x correspond to the grid points used for the interpolation calculation. However, both of them are actually present in a three-dimensional space having a component in a* direction, so that the number of the grid points used for the interpolation further increases.

Instead of determining the CMY value in such a manner, it is applicable to calculate the average of the L*a*b* values of two colors that are difficult to distinguish, calculate the CMY value with which the color difference becomes minimum with respect to the L*a*b* value, and set it (the CMY value calculated above) as a common CMY value of the grid points used for the interpolation. Such a process is performed on all combinations of colors that are difficult to distinguish.

In the case of taking the average of the CMY values or the L*a*b* values, continuity of the conversion table is not easily lost. In the case of using the minimum value of the total of the CMY values, density of a portion converted into the same color can be made small, so that a consumption amount of a color material for the image formation of the output device can be suppressed. However, when the continuity of the conversion table is lost and a gradation image or the like is input, a tone jump may occur.

The conversion table, in which the CMY values of some grid points are converted in this manner, can provide a color conversion to replace colors which are difficult to distinguish for the P-type colorblind people in the input image data with the same color to output.

(3) Generating Method of Conversion Table of Third Color-Signal Converting Unit 23 (D-Type Color Vision is Emphatically Simulated) and Generating Method of Conversion Table of Fourth Color-Signal Converting Unit 24 (T-Type Color Vision is Emphatically Simulated)

The following Equation (8) is an equation for converting into a signal that simulates the cone response of the D-type color vision people, which corresponds to Equation (5) in the case of the P-type color vision people. Although other equations are omitted, in the similar manner to the P-type color vision, it is possible to generate the conversion tables that replace colors that are difficult to distinguish for people having respective color vision properties with the same color for the D-type color vision and T-type color vision.

$$\begin{bmatrix} L_D \\ M_D \\ S_D \end{bmatrix} = \begin{bmatrix} L \\ 0.494207L + 1.24827S \\ S \end{bmatrix} \tag{8}$$

Figure 5:
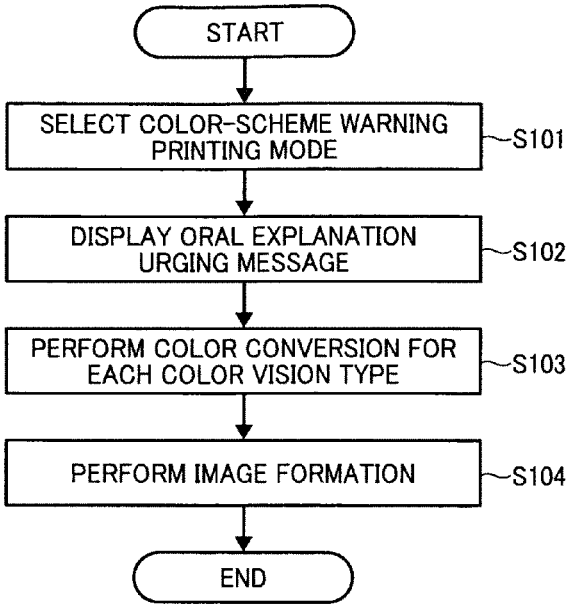
FIG. 5 is a flowchart illustrating an example of an overall flow of an image forming process by the image processing apparatus in the first embodiment.
Figure 6:
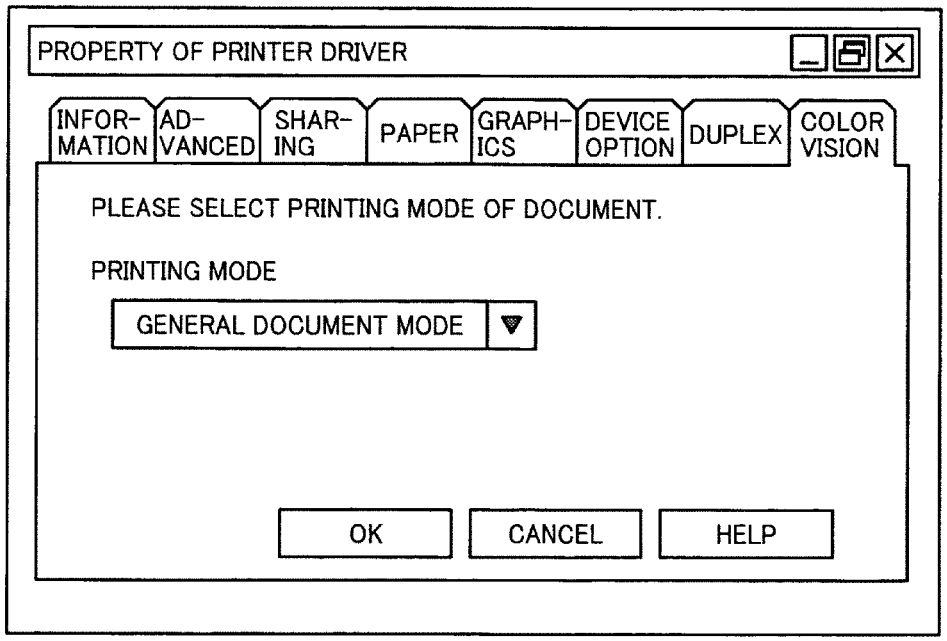
FIG. 6 is a diagram illustrating an example of a screen when selected is a printing mode.
Figure 7:
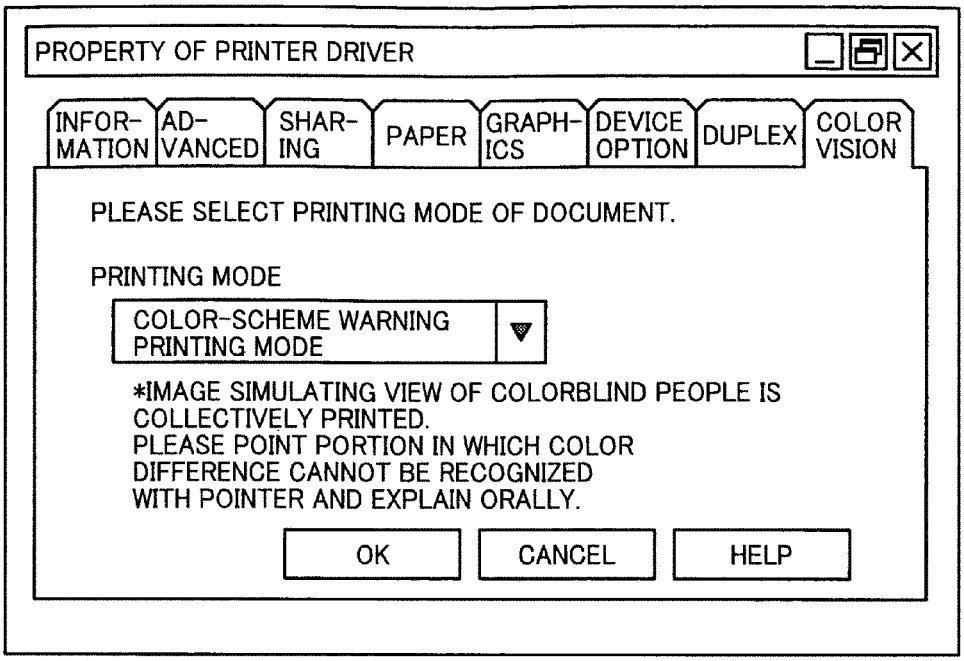
FIG. 7 is a diagram illustrating an example of a screen after a color-scheme warning printing mode is selected.

Next, an operation of the image processing apparatus 100 in the first embodiment is explained in detail with reference to FIG. 5 to FIG. 7. FIG. 5 is a flowchart illustrating an example of an overall flow of an image forming process by the image processing apparatus 100 in the first embodiment. FIG. 6 is a diagram illustrating an example of a screen for selecting the printing mode. FIG. 7 is a diagram illustrating an example of a screen after the color-scheme warning printing mode is selected.

First, when a user of the image processing apparatus 100 selects the color-scheme warning printing mode on a screen (FIG. 6) for selecting the printing mode that is displayed on the display device or the like, the output-form designating unit 1 receives the selection (Step S101).

When the color-scheme warning printing mode is selected, the output-form designating unit 1 displays on the display device to notify that an image simulating a view of the colorblind people is to be printed and urge an oral explanation by pointing a portion in which the color difference cannot be recognized (Step S102). FIG. 7 represents an example of the screen on which such messages are displayed.

Next, the color converting unit 2 converts the input image data in the RGB color space into the image forming data in the CMY color space (Step S103). Specifically, each signal converting unit (the first color-signal converting unit 21, the second color-signal converting unit 22, the third color-signal converting unit 23, and the fourth color-signal converting unit 24) included in the color converting unit 2 converts the RGB value into the CMY value by using the conversion table that simulates a corresponding predetermined color vision property (color vision type).

Next, the image formation control unit 3 controls the image formation by using the image forming unit 6 so that the image forming data converted by the color converting unit 2 is collectively printed or is printed on both sides to perform the image forming process (Step S104).

In this manner, the image processing apparatus in the first embodiment replaces colors, which are easily confused by the colorblind people, in the input image data with the same color to output. Whereby, a problem is prevented that the common color vision people have a difficulty in determining whether the color difference is difficult to distinguish for the colorblind people. Therefore, a trouble is prevented that, for example, colors are further replaced by a different color after being determined that the color difference is difficult to distinguish. In other words, increase of a load at the time of document creation and limitation of a degree of freedom in design can be avoided.

An image processing apparatus in a second embodiment synthesizes images in which colors, which are difficult to distinguish for any of the P-type color vision people and the D-type color vision people, are replaced by the same color (for example, black) to output. Whereby, it is possible to reduce a trouble that the common color vision people search for a portion that is difficult to distinguish by comparing images for respective color vision properties. The combination of the color vision types is not limited to the P-type and the D-type, and other arbitrary combinations can be applied. Moreover, three color vision types can be combined.

In the second embodiment, the function of the color converting unit 2 (see FIG. 1 and FIG. 2) in the first embodiment is changed. Other configurations are similar to the first embodiment, so that explanation thereof is omitted.

Figure 8:
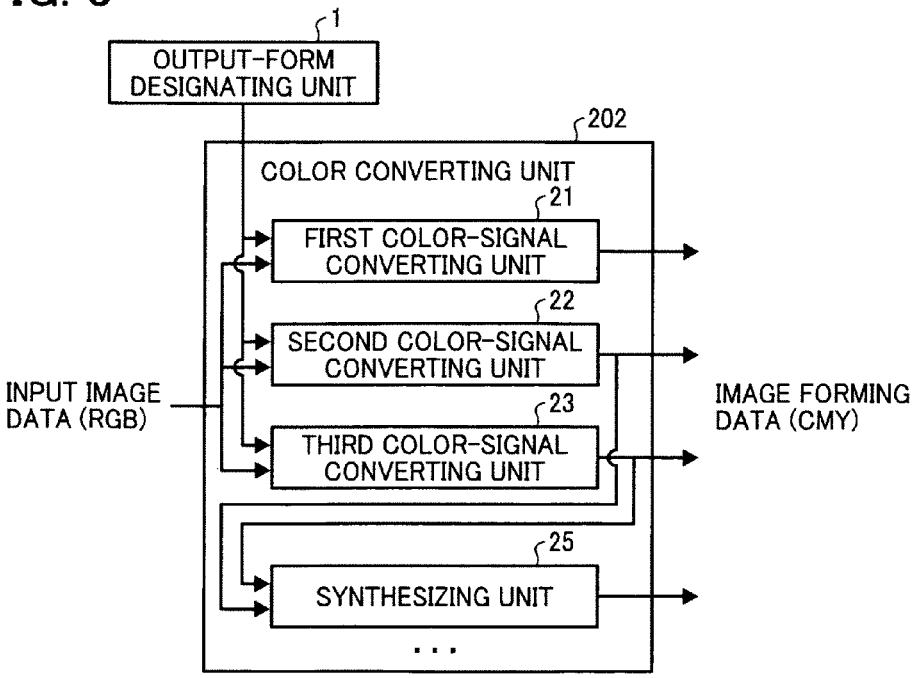
FIG. 8 is a diagram illustrating a configuration example of a color converting unit in a second embodiment.

FIG. 8 is a diagram illustrating a configuration example of a color converting unit 202 in the second embodiment. As shown in FIG. 8, the color converting unit 202 includes a synthesizing unit 25 instead of the fourth color-signal converting unit 24, which is different from the color converting unit 2 in the first embodiment. Other configurations are similar to FIG. 2, so that explanation thereof is omitted.

The synthesizing unit 25 synthesizes an output of the second color-signal converting unit 22 and an output of the third color-signal converting unit 23 so as to make fourth image forming data. Specifically, the synthesizing unit 25 receives the image forming data in the CMY color space created as a result of emphatically simulating the views of the P-type color vision and the D-type color vision from the second color-signal converting unit 22 and the third color-signal converting unit 23. In the followings, these are called a P-type simulated image and a D-type simulated image, respectively.

Next, the synthesizing unit 25 compares the CMY value of the first pixel of the P-type simulated image with the second pixel of the P-type simulated image. The synthesizing unit 25 concurrently compares the first pixel of the D-type simulated image with the second pixel of the D-type simulated image. When the first pixel and the second pixel match in any of the P-type simulated image and the D-type simulated image, the synthesizing unit 25 sets a second pixel of a newly synthesized image (synthetic image data) to the CMY value of the first pixel of the P-type simulated image. Instead of the CMY value of the first pixel of the P-type simulated image, it can be configured to set to the CMY value of the first pixel of the D-type simulated image or black (C,M,Y)=(255,255,255).

On the other hand, when the first pixel and the second pixel do not match in any of them, the synthesizing unit 25 sets the second pixel of the synthetic image data to the CMY value of the second pixel of the P-type simulated image. In this case, it is applicable to configure such that the second pixel of the synthetic image data is set to the CMY value of the second pixel of the D-type simulated image. In other words, it can be configured such that the color vision property to be employed when the pixels do not match is predetermined (in this example, P-type or D-type), and when the pixels do not match, the CMY value of the pixel of the simulated image of this color vision property is employed.

The synthesizing unit 25 sets the first pixel of the synthetic image data to the CMY value of the first pixel of the P-type simulated image. For example, in an end portion of a paper sheet, all of adjacent pixels are white in some cases. In such a case, for example, if it is configured to be replaced by black because the pixel values of the adjacent pixels match white, a problem arises such as wasting toner, and giving uncomfortable feeling. Therefore, when determining whether the first pixel and the second pixel match, in the case of the pixel to be determined is (C,M,Y)=(0,0,0), i.e., in the case that the pixel is white, the synthesizing unit 25 sets (C,M,Y)=(0,0,0) as a pixel value of a comparison target regardless of matching or non-matching.

In the similar manner, the synthesizing unit 25 repeats a process of comparing the first pixel with the third pixel and setting the third pixel of the synthetic image data in accordance with a comparison result until comparing the first pixel with the last pixel. Then, after comparing the first pixel with the last pixel, the synthesizing unit 25 repeats the comparing process, such as the second pixel with the third pixel, the second pixel with the fourth pixel, . . . , the second pixel with the last pixel, the third pixel with and the fourth pixel, . . . , until a pixel of a comparison source reaches the last pixel.

With such a process, the images, in which colors that are difficult to distinguish for any of the P-type color vision people and the D-type color vision people are replaced by the same color (including black), are synthesized. Whereby, a user can recognize a portion that is difficult to distinguish for any of the color vision properties by viewing only one image. For example, a case is assumed in which a color 1 and a color 2 are difficult to distinguish for the P-type, and the color 2 and a color 3 are difficult to distinguish for the D-type. In this case, with the method in the second embodiment, all of the color 1, the color 2, and the color 3 are replaced by the same color. The combination of these colors is the color scheme that is difficult to distinguish when viewed by people having any color vision property, so that when the common color vision people use it for an explanatory material, it is needed to specifically point a portion in which all of the colors are used and explain by another method, for example, orally.

Figure 9:
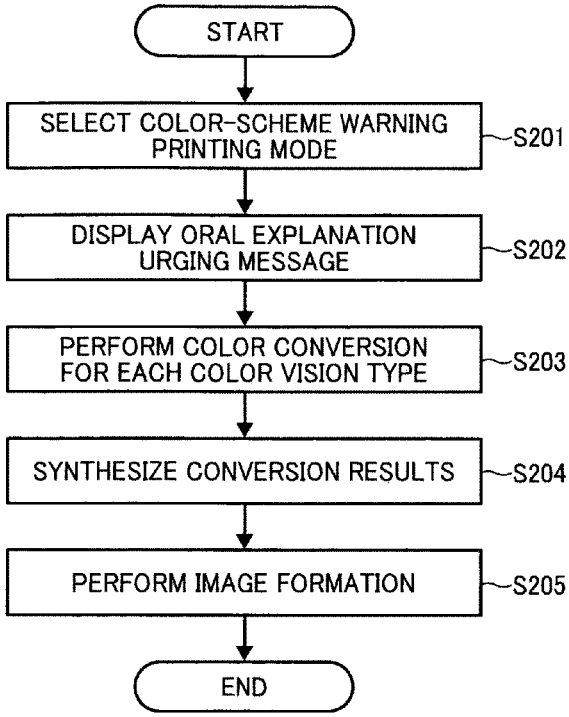
FIG. 9 is a flowchart illustrating an example of an overall flow of the image forming process in an image processing apparatus in the second embodiment.

Next, an operation of the image processing apparatus in the second embodiment is explained in detail with reference to FIG. 9. FIG. 9 is a flowchart illustrating an example of an overall flow of the image forming process by the image processing apparatus in the second embodiment.

The processes from Step S201 to Step S202 are similar to those from Step S101 to Step S102 in the image processing apparatus 100 according to the first embodiment, thus explanation thereof is omitted.

At Step S203, the color converting unit 202 converts the input image data in the RGB color space into the image forming data in the CMY color space (Step S203). In the present embodiment, three signal converting units (the first color-signal converting unit 21, the second color-signal converting unit 22, and the third color-signal converting unit 23) included in the color converting unit 202 convert the RGB value into the CMY value by using the conversion tables that simulate the corresponding predetermined color vision properties (color vision types).

Next, the synthesizing unit 25 synthesizes a conversion result by the second color-signal converting unit 22 and a conversion result by the third color-signal converting unit 23 so that generates the fourth image forming data (Step S204).

Next, the image formation control unit 3 controls the image forming unit 6 so that outputs the image forming data converted by the color converting unit 202 as collectively printed or as both sides so as to perform the image forming process (Step S205).

In this manner, the image processing apparatus in the second embodiment synthesizes images in which colors that are difficult to distinguish for any of a plurality of types of the color vision people are replaced by the same color, and outputs. Whereby, it is possible to reduce a trouble that the common color vision people search for a portion that is difficult to distinguish by comparing images for respective color vision properties.

An image processing apparatus in a third embodiment dynamically converts colors into the same color in accordance with the input image data.

Figure 10:
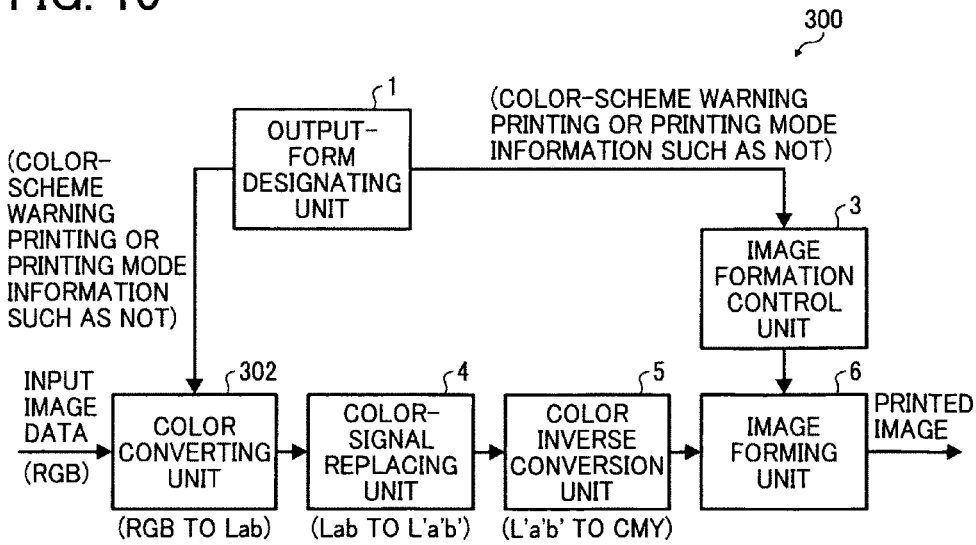
FIG. 10 is a block diagram illustrating a configuration example of an image processing apparatus according to a third embodiment.

FIG. 10 is a block diagram illustrating a configuration example of an image processing apparatus 300 according to the third embodiment. As shown in FIG. 10, the image processing apparatus 300 includes the output-form designating unit 1, a color converting unit 302, the image formation control unit 3, a color-signal replacing unit 4, a color inverse conversion unit 5, and the image forming unit 6.

In the third embodiment, the function of the color converting unit 302 and addition of the color-signal replacing unit 4 and the color inverse conversion unit 5 are different from the first embodiment.

The color converting unit 302 converts the input image data into image data (hereinafter, Lab image data) of the CIELAB color space, instead of converting into the image forming data of the output device, which is different from the color converting unit 2 in the first embodiment.

The color-signal replacing unit 4 replaces colors, which are easily confused by the colorblind people, in the Lab image data after the conversion by the color converting unit 302 with the same color.

The color inverse conversion unit 5 converts the Lab image data after being replaced by the color-signal replacing unit 4 into the CMY data (image forming data) for the image formation of the output device.

Figure 11:
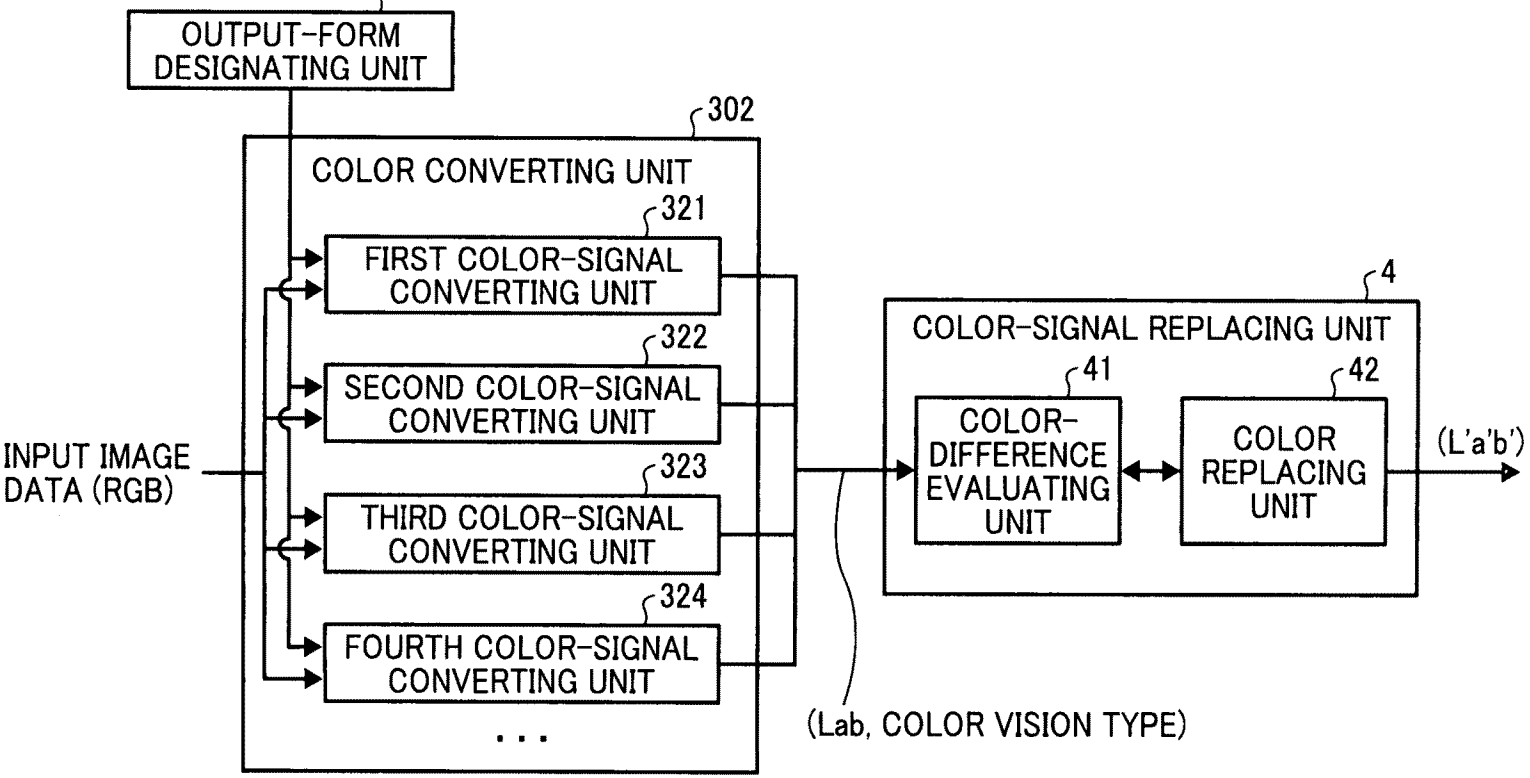
FIG. 11 is a block diagram illustrating a configuration example of a color converting unit and a color-signal replacing unit in the third embodiment.

FIG. 11 is a block diagram illustrating a configuration example of the color converting unit 302 and the color-signal replacing unit 4 in the third embodiment. As shown in FIG. 11, the color converting unit 302 includes a first color-signal converting unit 321, a second color-signal converting unit 322, a third color-signal converting unit 323, and a fourth color-signal converting unit 324.

The first color-signal converting unit 321, the second color-signal converting unit 322, the third color-signal converting unit 323, and the fourth color-signal converting unit 324 convert the input image data into the image forming data by using the conversion tables that convert into the Lab value, instead of converting into the CMY value. This is different from the first color-signal converting unit 21, the second color-signal converting unit 22, the third color-signal converting unit 23, and the fourth color-signal converting unit 24 in the first embodiment.

In other words, the first color-signal converting unit 321, the second color-signal converting unit 322, the third color-signal converting unit 323, and the fourth color-signal converting unit 324 convert the input image data into the Lab value that simulates the view of the colorblind people and send it to the color-signal replacing unit 4 together with information indicating which color vision property is simulated.

The color-signal replacing unit 4 includes a color-difference evaluating unit 41 and a color replacing unit 42. The color-difference evaluating unit 41 evaluates and extracts a combination of colors in an image that are easily confused by the colorblind people. The color replacing unit 42 replaces the colors that are easily confused with the same color and sends the replaced Lab image data to the color inverse conversion unit 5.

Figure 12:
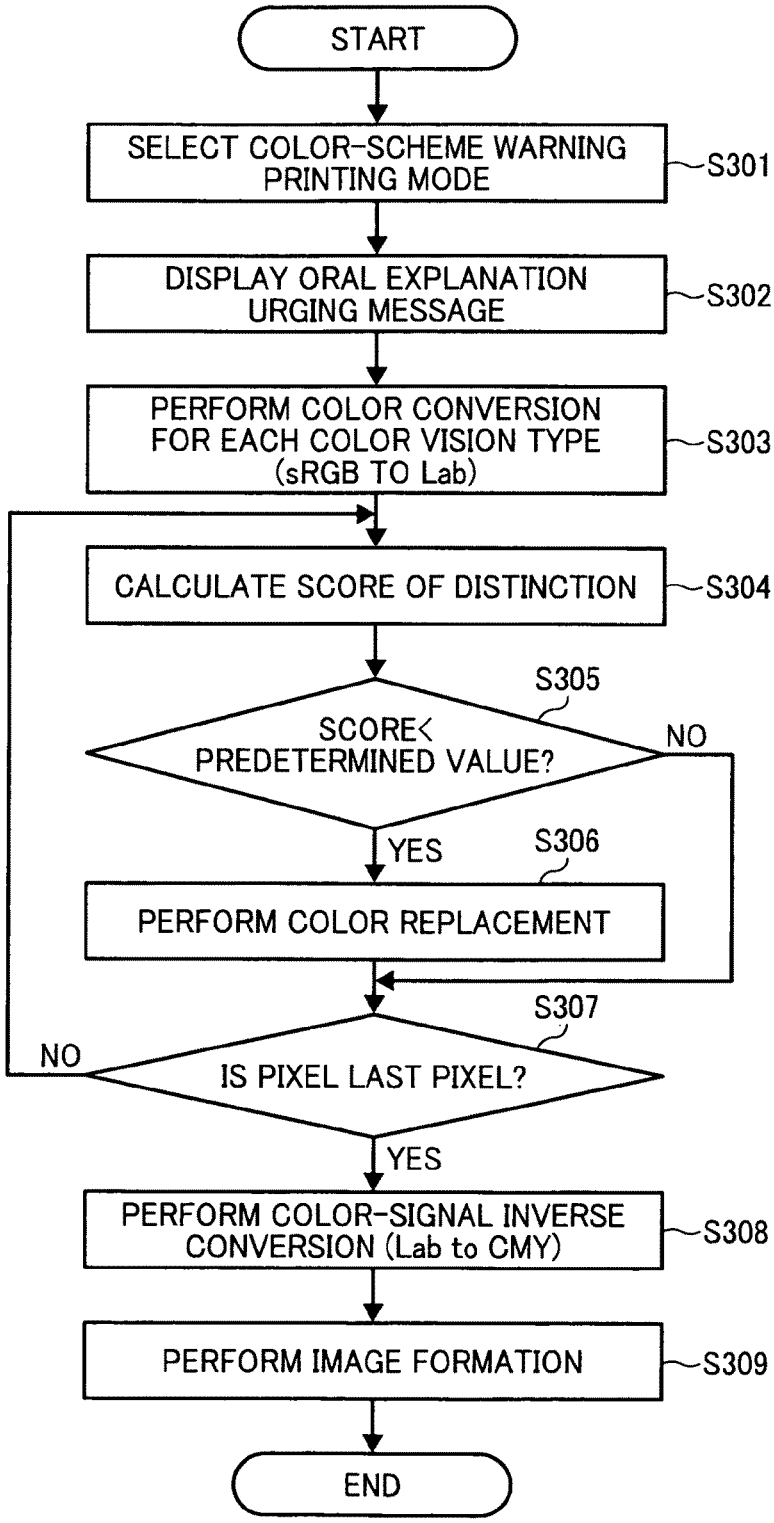
FIG. 12 is a flowchart illustrating an example of an overall flow of the image forming process by the image processing apparatus in the third embodiment.

Next, an operation of the image processing apparatus 300 in the third embodiment is explained in detail with reference to FIG. 12. FIG. 12 is a flowchart illustrating an example of an overall flow of the image forming process by the image processing apparatus 300 in the third embodiment.

The processes from Step S301 to Step S302 are similar to those from Step S101 to Step S102 in the image processing apparatus 100 according to the first embodiment, thus explanation thereof is omitted.

Next, the color converting unit 302 converts the input image data in the RGB color space into the Lab image data by using the conversion table that associates the RGB value with the L*a*b* value that simulates the amount of perception of each color vision property (Step S303). Specifically, each signal converting unit (the first color-signal converting unit 321, the second color-signal converting unit 322, the third color-signal converting unit 323, and the fourth color-signal converting unit 324 included in the color converting unit 302) converts the RGB value into the Lab value by using the conversion table that simulates a corresponding predetermined color vision property (color vision type). The color converting unit 302 sends the Lab image data after the conversion together with the information indicating which color vision type of the color vision property is simulated to the color-difference evaluating unit 41.

Next, when the Lab image data and the information indicating the color vision type are received, the color-difference evaluating unit 41 evaluates the distinction of a color between pixels by using an evaluation equation of the distinction for each color vision type (Step S304).

Specifically, first, the color-difference evaluating unit 41 calculates $\Delta L$, $\Delta b$, and $\Delta a$ that represent the difference of respective components of the Lab values of the first pixel and the second pixel. Next, the color-difference evaluating unit 41 calculates the score (Dist.) of the distinction by using the above Equation (7). The value of the constant k in Equation (7) is similar to the first embodiment.

Next, the color-difference evaluating unit 41 determines whether the value of the calculated score (Dist.) is a predetermined value (hereinafter, predetermined value=3) or less (Step S305).

When the score (Dist.) is less than three (Yes at Step S305), the color replacing unit 42 replaces the L*a*b* value of the second pixel with the L*a*b* value of the first pixel or black ((L*,a*,b*)=(0,0,0)) (Step S306).

When the score (Dist.) is three or more (No at Step S305), the L*a*b* value of the second pixel is not replaced and the L*a*b* value keeps its value without change. When a comparison source is white ((L*,a*,b*)=(100,0,0)), the replacement is not performed.

Next, the color-signal replacing unit 4 determines whether the pixel (first pixel in the first process) of the comparison source is the last pixel of the Lab image data (Step S307). When the pixel is not the last pixel (No at Step S307), the color-signal replacing unit 4 repeats the processes from Step S304 to Step S306 with the next pixel (for example, second pixel) as the comparison source and with a pixel (for example, third or subsequent pixel) after the pixel as a comparison target.

When the pixel of the comparison source is the last pixel (Yes at Step S307), the Lab image data subjected to the replacing process is sent to the color inverse conversion unit 5. Then, the color inverse conversion unit 5 generates the image forming data by converting the L*a*b* value of each pixel of the sent Lab image data into the CMY value for the image formation of the output device with which the color difference becomes small (Step S308).

For example, it is applicable that color samples in which the CMY values are variously combined are output and are subjected to the colorimetry in advance and the closest one is selected. Moreover, it is applicable that a few number of the color samples are output and are subjected to the colorimetry, a model that predicts the L*a*b* value to be output from the CMY value is constructed, and the CMY value with which the color difference becomes minimum is determined based on the model. Furthermore, it is applicable that the conversion table in which device characteristics of the output device are described is constructed in advance and the CMY value is calculated by the interpolation operation using the conversion table. The color inverse conversion unit 5 converts the Lab image data received from the color-signal replacing unit 4 into the image forming data in the CMY color space in this manner, and sends it to the image forming unit 6.

Next, the image formation control unit 3 controls the image formation by the image forming unit 6 so that the received image forming data is collectively printed or is printed on both sides on a recording medium such as paper to perform the image forming process (Step S309).

In this manner, the image processing apparatus in the third embodiment dynamically converts into the same color in accordance with the input image data. Although an amount of processing increases because of a pixel unit process, the color scheme does not need to be fixed.

As described above, recently, various colored characters or color images are used. Even if such various colors are used in a document, it is difficult to distinguish color information for people having trouble with the color vision. For example, in the case of the color vision with which red and green are difficult to distinguish, red and green are difficult to discriminate or cannot be discriminated at all in a graph in which red, green, and blue are used, so that such graph is only recognized as being composed of two color elements of blue and other than blue in some cases. Moreover, because a color image output apparatus can express multiple colors, the color scheme is sometimes difficult to discriminate even for people having a common color vision property.

Figure 13:
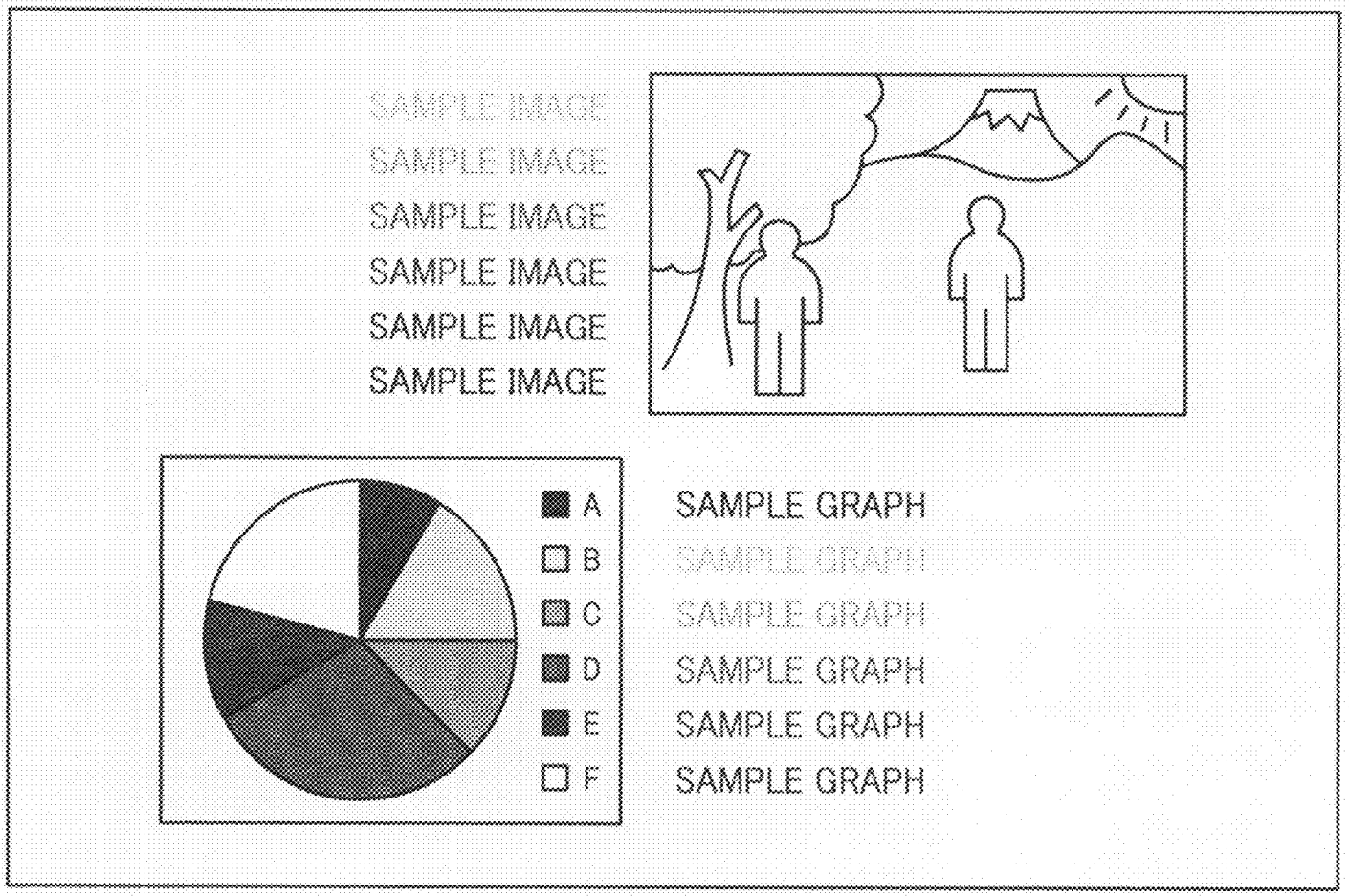
FIG. 13 is a diagram illustrating a document example including a graph and color characters.

FIG. 13 illustrates a document example that includes color characters, a circle graph, and a photograph. In the graph shown in FIG. 13, color-coding of the circle graph is such that area is relatively large and colors are in contact with each other, so that the difference of the colors is relatively easy to understand. It is needed for reading information on this graph to associate with a legend. However, area of the legend portion is small, so that the difference between the colors is difficult to recognize, which makes it difficult to associate with the portion of the circle graph. In the similar manner, if the color character has a thin character style such as Ming-style typeface and is small in size, selective use of the color characters is difficult to recognize. On the other hand, in the case of an image of a natural object such as a photograph, a target and a color name are often experimentally associated with each other (leaf is green, human face is flesh color, and the like), and the color-coding itself does not have any meaning in most cases.

Conventionally, considering such a color vision deficiency, for example, an apparatus is proposed in which, for causing the colorblind people to easily discriminate a plurality of colors, a luminance component is reduced in any one of a case where a first-axis component is a predetermined value or more and a case where the first-axis component is the predetermined value or less and the luminance component is increased in the other case in accordance with the first-axis component among the luminance component and other two components and a second-axis component is reduced in accordance with the change of the luminance component (see Japanese Patent No. 3867988).

Moreover, an apparatus is proposed in which a color vision deficiency type is input and confusion colors in document data are searched for in accordance therewith, and, if there is information on a past color change in the case where the colors need to be changed, a color change is performed based on the information (see Japanese Patent No. 4155051).

Furthermore, an apparatus is proposed in which preregistered information on colors that tend to be misrecognized by the colorblind people is referenced and it is determined whether the colors are included in the input image data, and, when determined to be included, the colors are converted into a predetermined color (see Japanese Patent Application Laid-open No. 2006-246072).

However, in the above Japanese Patent No. 3867988, although the luminance component is changed in accordance with the first-axis component and the second-axis component is reduced in accordance therewith, area of a region in which the color is used is not considered. Therefore, as described above, the discrimination of a small area region, such as a legend of a graph, may not be sufficiently improved. Moreover, the second-axis component is reduced, so that, for example, when there is a color that is close in the b* axis direction, the discrimination may be degraded.

In the similar manner, in Japanese Patent No. 4155051 and Japanese Patent Application Laid-open No. 2006-246072, area of a region in which a color is used is not considered, so that the discrimination of a small area region may not be sufficiently improved.

Thus, in a fourth embodiment, explanation is given for an image processing apparatus 400 as a color adjusting apparatus that, when a color is used in a small area region, such as a legend of a graph or a character portion in an input color image, adjusts the color so that even the colorblind people can discriminate the difference of colors.

In the image processing apparatus 400 according to the fourth embodiment, even when the color included in the input color image is used in the small area region, the color is adjusted so that the colorblind people can easily discriminate the difference between colors.

Such adjustment of a color is premised on a process within the color reproduction range of the output device. Actually, a color outside the color reproduction range of the output device can also be a process target. Therefore, as described above, a problem arises that even if the color scheme is such that the difference between colors is easily recognized on a printing, the distinction of the colors cannot be improved in a projected image. Therefore, in the fourth embodiment, furthermore, confusion colors are converted into the same color by the methods in the above first to third embodiments. In other words, in order to consider the process outside the reproduction range, a portion in which the difference cannot be enlarged is converted into the same color by the methods used in the above first to third embodiments.

Whereby, it is possible to prevent problems of limitation in design and a trouble of changing the color scheme, such as avoiding use of a color that is difficult for the colorblind people to distinguish or replacing with a different color, when the distinction is not improved. In other words, increase of a load at a time of document creation and limitation of a degree of freedom in design can be avoided.

The configuration can be such that the process is performed up to the adjustment of a color considering area without performing the process of converting confusion colors into the same color by the methods used in the first to third embodiments.

In the fourth embodiment, when printer data described in PDL is input as the input image signal (input image data), a filled portion is extracted and the color difference is enlarged. The color vision property to be a target is the P/D-type color visions under which most of the colorblind people fall.

Figure 14:
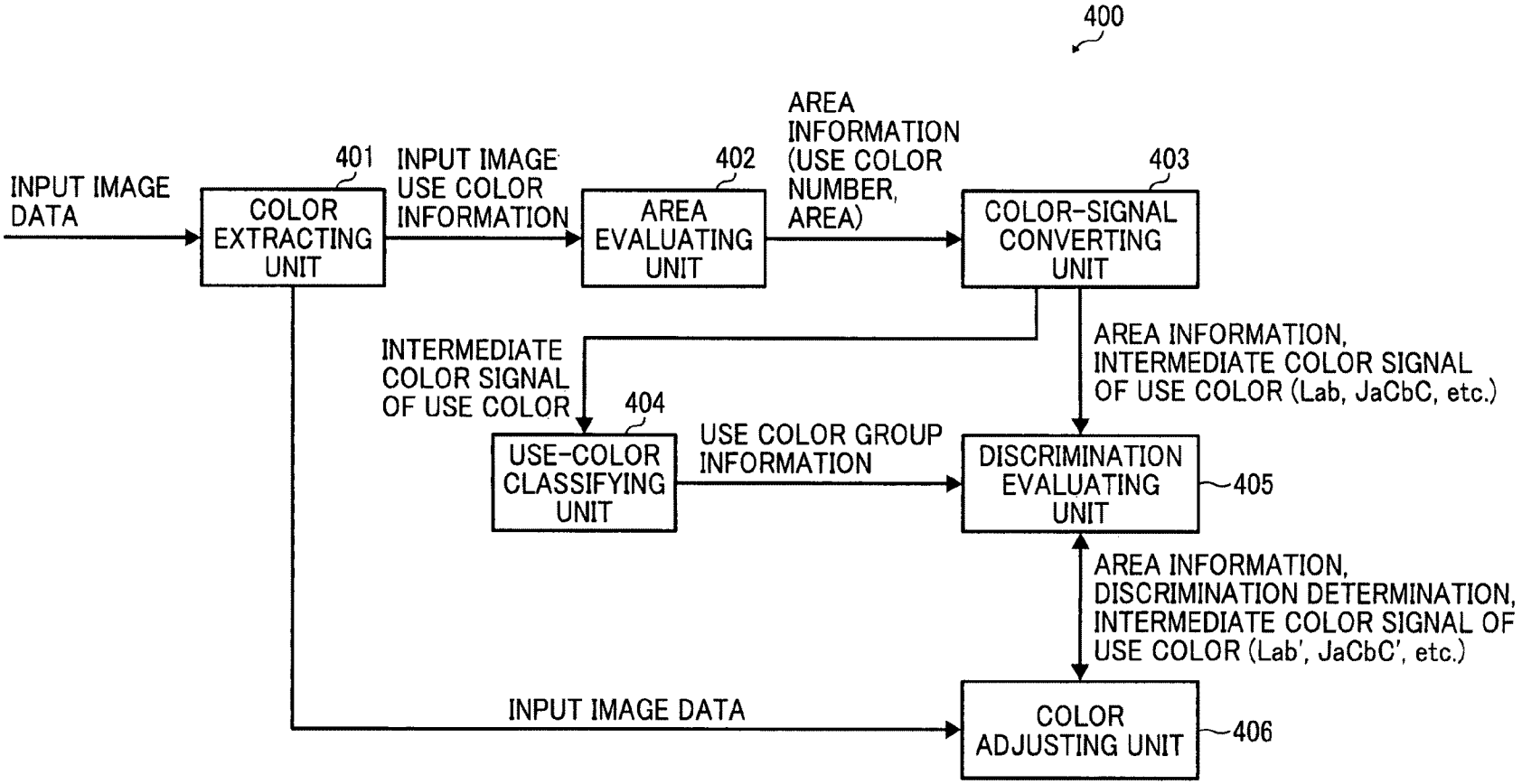
FIG. 14 is a diagram illustrating a configuration example of a color adjusting apparatus in a fourth embodiment.

FIG. 14 is a diagram illustrating a configuration of an image processing apparatus 400 in the fourth embodiment. As shown in FIG. 14, the image processing apparatus 400 includes a color extracting unit 401, an area evaluating unit 402, a color-signal converting unit 403, a use-color classifying unit 404, an discrimination evaluating unit 405, and a color adjusting unit (first color adjusting unit) 406. Although omitted in FIG. 14, the image processing apparatus 400 further includes each configuration unit in FIG. 1 or FIG. 10 that realizes any of the functions in the first to third embodiments.

In other words, the image processing apparatus 400 includes each configuration unit for forming an image by performing conversion into the same color for the input image data that is adjusted by the color adjusting unit 406.

The color extracting unit 401 extracts information on colors that are used for filling with the same color from the input image data. The area evaluating unit 402 calculates area of regions filled with the same color that are extracted by the color extracting unit 401. The color-signal converting unit 403 converts use colors of the input image data extracted by the color extracting unit 401 into intermediate color signals for performing a discrimination evaluation or a color adjustment. The use-color classifying unit 404 classifies the use colors into a plurality of groups in accordance with a value of a predetermined color component of the use colors converted into the intermediate color signals. The discrimination evaluating unit 405 evaluates the discrimination between the use colors for each group classified by the use-color classifying unit 404. The color adjusting unit 406 performs the color adjustment to improve the discrimination on the use colors of the input image data in accordance with the discrimination determination result or the like by the discrimination evaluating unit 405.

Figure 15:
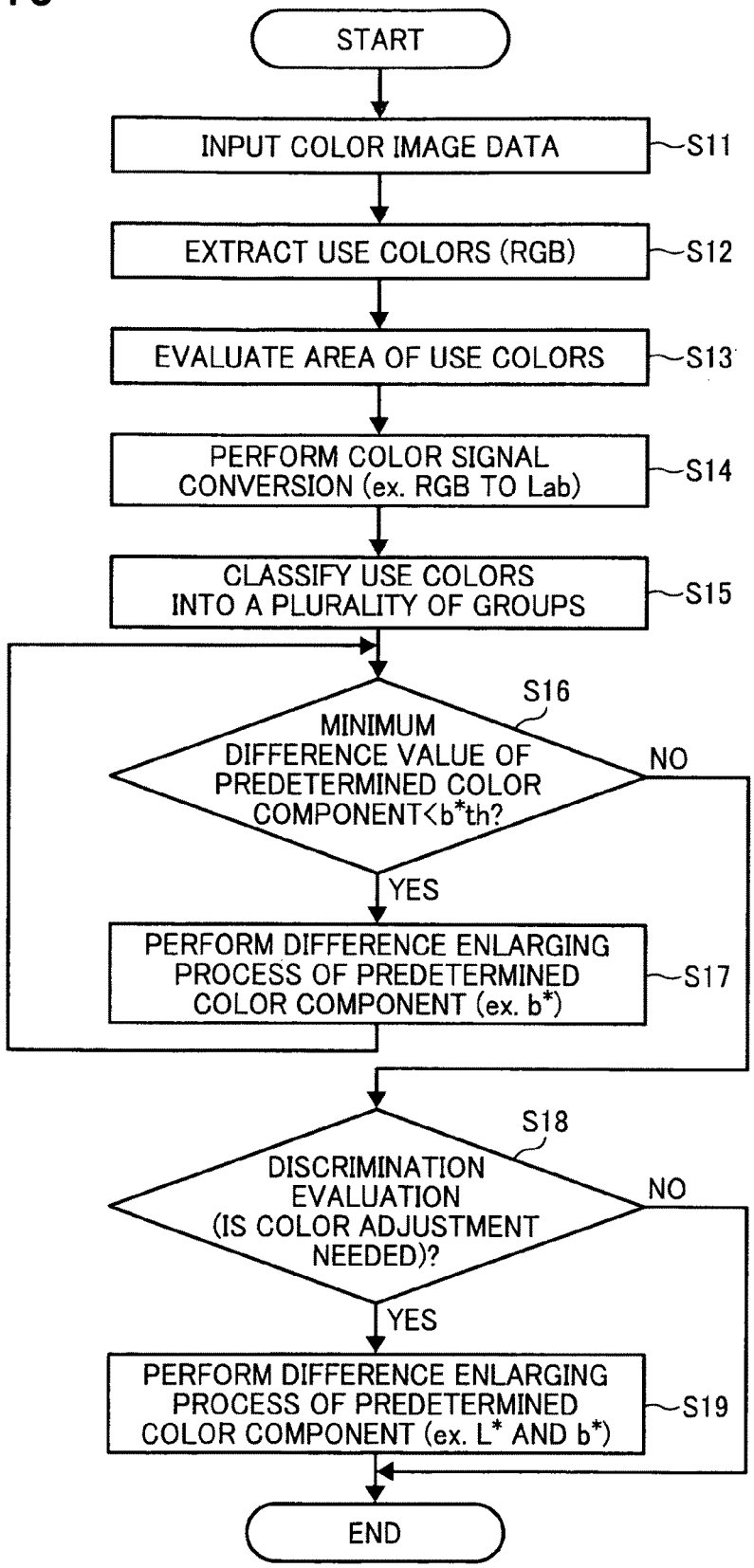
FIG. 15 is a process flowchart operated in the fourth and a fifth embodiments.

Next, explanation is given for a flow of the process of performing the color adjustment on the use colors of the input image data. FIG. 15 is a process flowchart in the fourth and fifth embodiments. In the fourth embodiment, processes at Steps S16 and S17 are not performed and the process proceeds to Step S18 after Step S15.

First, when the input image data is input (Step S11), the color extracting unit 401 extracts the RGB values of the filled regions included in the input image data (Step S12). In the present embodiment, explanation is given below for the case in which the RGB value is considered as the sRGB value that is frequently used for a typical office document; however, the RGB value is not necessarily the sRGB value. When an attribute of the RGB value is described in a header or the like of the input image data, the RGB value can be an extended RGB such as Adobe (registered trademark) RGB and scRGB, or the like.

Next, the area evaluating unit 402 performs evaluation of area of the filled regions included in the input image data (Step S13). Then, the color-signal converting unit 403 converts the RGB values of the filled regions included in the input image data into the intermediate color signals of the CIELAB or the like (Step S14). Then, the use-color classifying unit 404 classifies the use colors converted into the intermediate color signals into a plurality of groups (Step S15).

The discrimination evaluating unit 405 performs evaluation of the discrimination for each group to determine whether there is a combination of colors that are difficult to discriminate on the use colors classified into a plurality of groups by the use-color classifying unit 404 (Step S18). When a color having a problem in discrimination is not included in the same group (No at Step S18), the process ends; and when a color having a problem in the discrimination is included in the same group (Yes at Step S18), the color adjusting unit 406 performs a process of enlarging the difference of the predetermined color component in the group for improving discrimination (Step S19).

Thereafter, although omitted in FIG. 15, the image forming data, in which confusion colors are converted into the same color, is generated with the input image data whose colors are adjusted as a target by using any of the methods in the above first to third embodiments (any of the processes shown in FIG. 5, FIG. 9, and FIG. 12), which is performed as image forming process.

Next, the process in the fourth embodiment is explained in detail. First, image data to be a target is input. In this example, explanation is given on the premise that the input image data is described in the page description language (PDL). PDL is a programming language for instructing drawing to a printer, and can specify a character and a figure, and a drawing position, color, and the like thereof. FIGS. 17 and 18 illustrate examples of the input image data described in PDL.

When the input image data is input, the color extracting unit 401 extracts color information on character and figure in the input image data. Specifically, a description of a character color or a fill color of a region, such as FontColor and FillColor, in FIG. 17 is searched for, and numerical data (RGB value) subsequent thereto is extracted. At this time, when the color is the same as a color that is already extracted, the overlapping color is not extracted. FIG. 19A illustrates an extraction example. "No." indicates an extracted order and "RGB" indicates the RGB value of the use color, and others are used by the color-signal converting unit 403 or the like and therefore are all set to 0 at this time to be in an initialized state. The use color information extracted in such a manner and the input image data are sent to the area evaluating unit 402. Moreover, only the input image data is sent to the color adjusting unit 406.

When the input image data and the use color information are received, the area evaluating unit 402 performs evaluation of area of a region in which the use color is used. The area evaluating unit 402 references the RGB value of the first color on the use color information such as shown in FIG. 19A, and searches for a portion in which the same RGB value is set in the input image data. Then, when the matching color information is found, the area evaluating unit 402 searches for a description having information on a character size or a size of a filled region, such as FontSize or RectFill, around it. Then, the area evaluating unit 402 sets a square value of FontSize in the case of FontSize and sets area of a figure in the case of the figure as area information. In the example shown in FIG. 17, four numerical values following C302:RectFill indicate {x coordinate, y coordinate, width, height}. Therefore, the area evaluating unit 402 sets width×height, i.e., 20*20=400, as the area information. In the case of a character string, the area evaluating unit 402 sets 100 that is a square of a font size 10 designated in C101 as the area information. In this manner, the area evaluating unit 402 calculates the area information for each use color, and, when the same color is used at a plurality of portions, employs a minimum area as an area evaluation value. In other words, in the case of, for example, a circle graph and its legend, typically, area of a portion of the legend is employed rather than area of a portion of an arc and a sector. The use color information (FIG. 19B), to which the area information (S) calculated in this manner is added, is sent to the color-signal converting unit 403.

When the use color information is received from the area evaluating unit 402, the color-signal converting unit 403 converts the RGB (in this example, sRGB) value into the intermediate color signal (in this example, CIELAB) for each use color. In the conversion into the intermediate color signal, the color-signal converting unit 403 first converts the input sRGB color signal into the XYZ tristimulus value based on a specification (IEC/4WD 61966-2-1: Colour Measurement and Management in Multimedia Systems and Equipment-Part 2-1: Default RGB Colour Space-sRGB) of the sRGB (above described Equation (1) to Equation (3)). Moreover, the color-signal converting unit 403 calculates the L*a*b* value in accordance with the definition of the CIELAB color system. The color-signal converting unit 403 sends the use color information (FIG. 20A), to which the intermediate color signal calculated in this manner is added, to the use-color classifying unit 404 and the discrimination evaluating unit 405.

When the use color information is received from the color-signal converting unit 403, the use-color classifying unit 404 classifies each use color into two groups in accordance with whether b* component is plus or minus and sends classification information thereof to the discrimination evaluating unit 405. In the case of an example in FIG. 20A, the use colors are classified into two groups of Nos. 1, 4, and 5 (Gr=1, meaning group 1) in which the *b value is minus and Nos. 2, 3, and 6 (Gr=2) in which the *b value is plus. When the use color information is received from the color-signal converting unit 403 and group information Gr of the use colors is received from the use-color classifying unit 404, the discrimination evaluating unit 405 performs evaluation of the discrimination for each classified group. The discrimination evaluating unit 405 evaluates the discrimination for each group after the classification with respect to all combinations of the colors in the group. The discrimination evaluating unit 405 performs a subjective evaluation experiment or the like and constructs an evaluation equation that associates a lightness difference or a difference of other color components with ease of discrimination in advance, and evaluates the discrimination using the evaluation equation. An example of the discrimination evaluation equation is represented by Equation (9).

$$(\text{Dist.})=S/225\times(0.167\times|\Delta L^*|+0.125\times|\Delta b^*|) \quad (9)$$

In Equation (9), S is area of an evaluation target region, ΔL* is a lightness difference between two colors of an evaluation target and a comparison target, and Δb* is a b* component difference between two colors. The evaluation value Dist becomes small as the area becomes small, and the same is true for ΔL* and Δb*.

In FIG. 20B, for example, in the case of evaluating the discrimination of No. 1, evaluation of the discrimination is performed with respect to Nos. 4 and 5 in the same group.

Evaluation with respect to No. 4 is as follows.

$$\text{Dist.}=100/225*(0.167*|147.09-41.961|+0.125*|-33.08+26.631|)=0.74$$

Evaluation with respect to No. 5 is as follows.

$$\text{Dist.}=100/225*(0.167*|47.09-58.671|+0.125*|-33.08+19.78|)=1.60$$

In this case, 0.74 indicating the lower discrimination is employed as the discrimination evaluation value of No. 1 (FIG. 20B).

On the other hand, for the discrimination evaluation of No. 2, the evaluation values with respect to No. 3 and No. 6 are 5.81 and 6.88, respectively, so that 5.81 is set as the evaluation value. The discrimination evaluation value Dist. calculated in such a manner is added to the use color information to be sent to the color adjusting unit 406.

The color adjusting unit 406 receives the use color information (FIG. 20B) from the discrimination evaluating unit 405, and receives the input image data from the color extracting unit 401. When there is a value less than a predetermined value (for example, 2.5) in the evaluation values (Dist.) of the discrimination in the received use color information, the color adjusting unit 406 performs the color adjustment for improving the discrimination with respect to the colors in the group including the color. The color adjustment is explained below.

In FIG. 20B, first, a color whose L* is the middle is to be determined. Because this example explains Nos. 1, 4, and 5, the lightness of No. 1 becomes the middle of the three colors. Then, this color is fixed and the lightness of other two colors is adjusted so that the evaluation value becomes the predetermined value (for example, 2.5) or more (FIG. 21A). (When the lightness of the central color has a bias to deviate from the range of 40 to 60, other colors are adjusted equally by the same lightness so that the central lightness becomes, for example, 50, and the following adjustment is performed on the adjusted colors.) At this time, the value of Δb* is first fixed and only the lightness is adjusted. In the case of the color of No. 5, when the lightness is adjusted to 70.87, the evaluation value becomes 2.5, so that the discrimination with respect to No. 1 becomes the predetermined value or more. On the other hand, in the case of the color of No. 4, even if the lightness is adjusted to 20.0, the discrimination becomes only 2.37, so that it cannot be said that sufficient discrimination is ensured. The lightness is set to 20 in view of the color reproduction range of the image forming apparatus such as a color printer. In this example, 20 is set as the lower limit of the lightness below which the lightness cannot be expressed. However, the color reproduction range is different significantly depending on the image forming method or the like, so that the lower limit can be set to be larger or smaller than 20. In the similar manner, although 70.87 is allowed on the assumption that the upper limit is 80 in this example, the upper limit may be set to about 70 depending on the image forming method.

Even if the lightness of No. 4 is lowered, the discrimination with respect to No. 1 cannot be ensured. In such a case, the b* component is adjusted subsequent to L*. When the b* component is adjusted to about 23.9 to enlarge the difference value from the b* component of No. 1, the evaluation value becomes about 2.5, so that the discrimination becomes the predetermined value or more (FIG. 21A). FIG. 21B is the color adjusting table that is generated by converting the L*a*b* value adjusted as above into the sRGB value by an inverse conversion of S14.

When the RGB value of the description of FontColor or FillColor in the input image data matches the RGB value in the table, the color adjusting unit 406 replaces the RGB value with R'G'B' value after the adjustment. An example thereof is FIG. 18. Only information on a character color and a color of a filled region of C102 and C103 is replaced.

Explanation is given for the color adjustment for improving the discrimination, in which the color vision type to be a target is premised on the P/D-types. In the case of improving the discrimination of the T-type color vision people, it is sufficient that the discrimination evaluation and the color adjusting process are performed while replacing b* with a*. In other words, the P/D-type color vision people can discriminate the difference of the color component in L* direction and in b* direction equally or to a greater extent than the common color vision people; however, cannot recognize the difference of the color component in the a* direction. Therefore, the discrimination is improved by emphasizing the difference of the L* and b* components. On the other hand, the T-type color vision people discriminate the difference of L* and a* equally or to a greater extent than the common color vision people; however, has a difficulty in recognizing the difference of the b* component, so that the difference of the L* and a* components needs to be emphasized.

In the present embodiment explained above, colors used in the input image data are subjected to the color adjustment in accordance with evaluation of the discrimination considering area, so that even when the colorblind people browse a graph image including a small area legend or the like, the color adjustment can be performed so that the colors can be easily discriminated. Moreover, the colors are classified into groups in accordance with whether the b* component is plus or minus or the like and the color adjustment is performed for each group, so that the color adjustment can be easily performed without considering the discrimination of colors that are relatively not easily confused.

According to the present embodiment, because evaluation of the discrimination and the color adjustment are performed in accordance with area of a filled region in the input image data, even a color with which the color difference is difficult to recognize, such as a legend in a graph and a color of a character, can be subjected to the color adjustment so that the discrimination is improved for the colorblind people. Because the luminance component and a predetermined second color signal component, which the P/D-type colorblind people easily discriminate equally or to a greater extent than the common color vision people, are adjusted, the color adjustment can be performed to improve the discrimination even for the P/D-type colorblind people. Moreover, because the luminance component and a predetermined third color signal component, which the T-type colorblind people easily discriminate equally or to a greater extent than the common color vision people, are adjusted, the color adjustment can be performed to improve the discrimination even for the T-type colorblind people. Furthermore, the color adjusting amount is increased as area is small, so that the color adjustment can be performed to improve the discrimination of a color even for a target, such as a legend of a graph or a color character, in which a color is difficult to recognize.

In the fifth embodiment, when the use colors in the input image data are classified into two groups in accordance with whether the b* component is plus or minus, and if there are colors between which difference of the b* component is smaller than a predetermined value between the different groups, the difference of the b* component is emphasized in advance and evaluation of the discrimination and the color adjustment are performed for each group.

Figure 16:
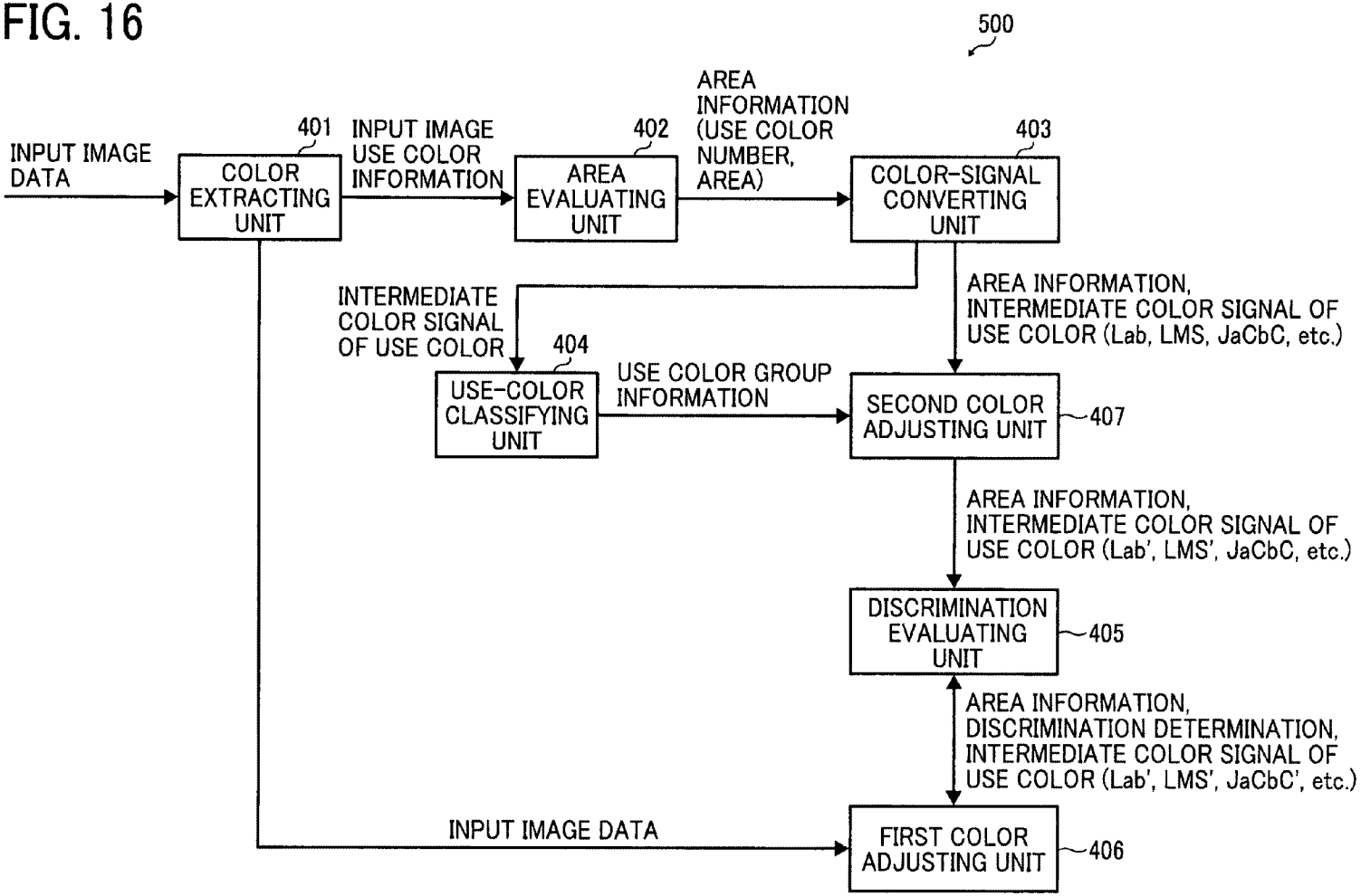
FIG. 16 is a diagram illustrating a configuration of a color adjusting apparatus in the fifth embodiment.

FIG. 16 is a block diagram illustrating a configuration example of an image processing apparatus 500 as a color adjusting apparatus in the fifth embodiment. In the fifth embodiment, a second color adjusting unit 407 is added to the configuration in the fourth embodiment. FIG. 15 is the process flowchart in the fourth and fifth embodiments. In the fifth embodiment, the processes at Steps S16 and S17 are performed.

The process by the second color adjusting unit 407 is explained below. When the second color adjusting unit 407 receives the use color information from the color-signal converting unit 403 and the use color group information from the use-color classifying unit 404, the second color adjusting unit 407 extracts two colors whose difference of b* components is minimum between the different classified groups from different classified groups. In other words, the second color adjusting unit 407 extracts the color whose b* component is minimum in the group in which the b* component is plus, and extracts the color whose b* component is maximum (absolute value is minimum) in the group in which the b* component is minus (it is found from FIG. 20B that they correspond to No. 2 and No. 5, respectively). Then, the second color adjusting unit 407 calculates the b* component difference (absolute value) between these two colors. In the example shown in FIG. 20B, the second color adjusting unit 407 calculates the b* component difference Δb* as follows.

$$\Delta b^*=22.66-(-19.78)=42.44$$

When this value is less than a predetermined value (for example, 45), the difference (absolute value) of the b* component is enlarged (Steps S16 and S17).

For the color of No. 2

$$b^*=b^*+(45-42.44)/2=23.94$$

For the color of No. 5

$$b^*=b^*-(45-42.44)/2=-21.06$$

Then, when the color whose b* is minimum or maximum in each group is changed by this process, the second color adjusting unit 407 performs the similar process for these two colors to repeat until the difference of the b* component of the colors that are closest between the groups becomes 45 or more. In this example, a threshold is set to be 45 as an example; however, it is not limited to this, and can be set to a smaller value when area of the use color is extremely large and needs to use a larger value when the area is extremely small. Then, after Step S18, the process similar to the fourth embodiment is performed.

When the use colors are classified in accordance with whether the b* component is plus or minus, colors in the plus or minus look like yellow or blue that are colors in totally different systems, so that they are relatively not easily confused. However, for example, if the lightness of both of them is low, they both look like a dark gray and thus may be confused.

In the present embodiment explained above, after classifying the use colors into two in accordance with whether the b* component is plus or minus, the difference between colors, whose b* component difference is minimum between the groups, is adjusted to be the predetermined value or more in advance, so that the discrimination of all of the use colors can be ensured even if the color adjustment is performed for each group. In the present embodiment also, it is apparent that in the case of improving the discrimination of the T-type colorblind people, b* is replaced by a*.

According to the present embodiment, the use colors in the input image data are classified and the minimum b* component difference or a* component difference between the classified groups is adjusted to be the predetermined value or more, so that even when there are colors whose hue is close between the groups, the color adjustment can be performed to improve the discrimination.

Figure 22:
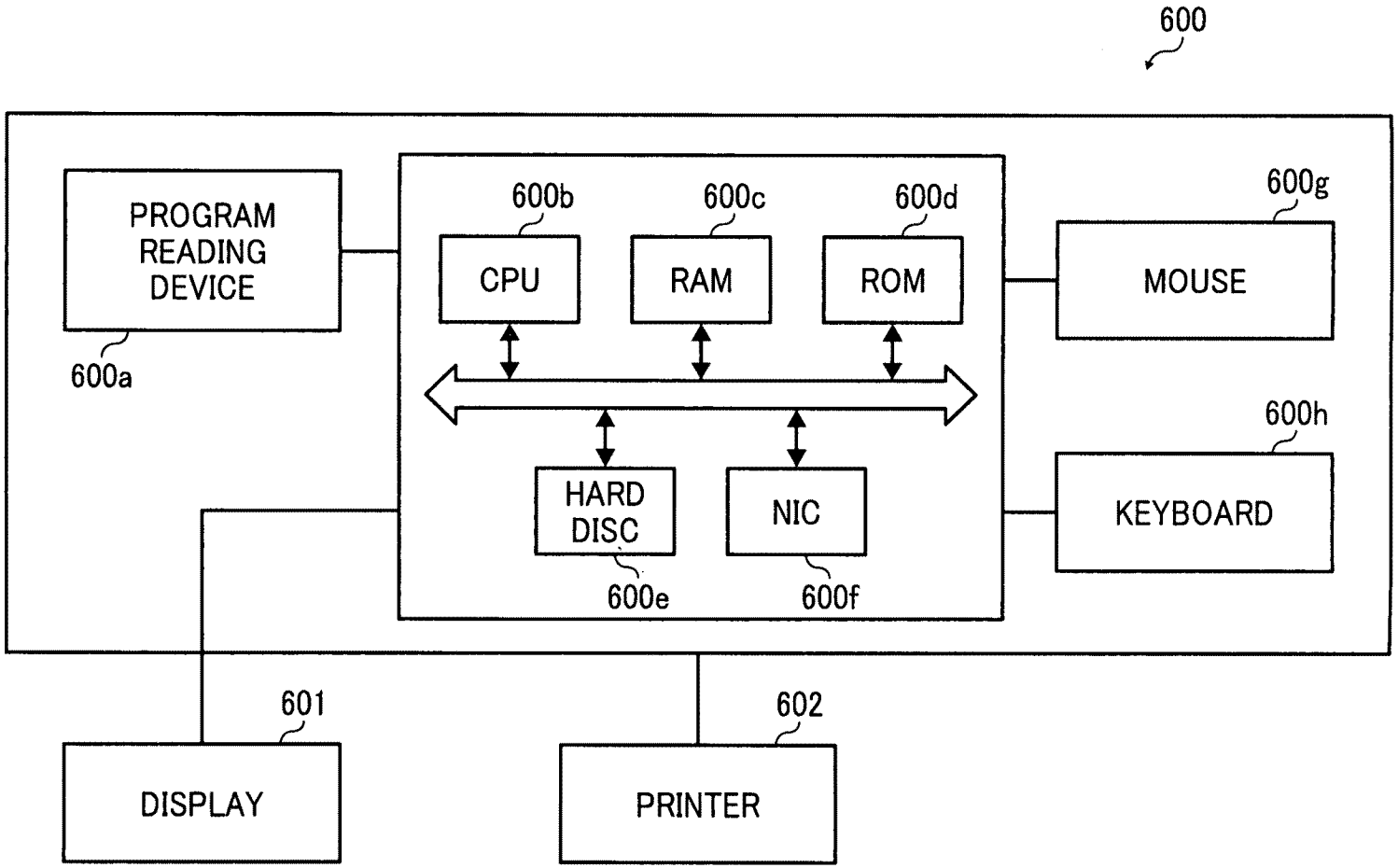
FIG. 22 is a diagram illustrating a hardware configuration example of the image processing apparatus.

FIG. 22 is a diagram illustrating a hardware configuration example of the image processing apparatus when the above each embodiment is performed in a software. A computer 600 corresponding to the image processing apparatus of the above each embodiment includes a program reading device 600*a*, a CPU 600*b* that controls the whole apparatus, a RAM 600*c* that is used as a work area or the like of the CPU 600*b*, a ROM 600*d* in which a control program or the like of the CPU 600*b* is stored, a hard disk 600*e*, a NIC 600*f*, a mouse 600*g*, a keyboard 600*h*, a display 601 capable of displaying image data and inputting information by a user directly touching a screen, and an image forming apparatus 602 such as a color printer. The image processing apparatus can be realized, for example, by a work station or a personal computer.

In the case of such a configuration, the functions of each configuration unit (the output-form designating unit 1, the color converting unit 2, the image formation control unit 3, the image forming unit 6, and the like) shown in FIG. 1 or FIG. 10, and the color extracting unit 401, the area evaluating unit 402, the color-signal converting unit 403, the use-color classifying unit 404, the discrimination evaluating unit 405, the color adjusting unit 406, and the second color adjusting unit 407 shown in FIG. 14 and FIG. 16 can be executed by the CPU 600*b*. The input image data, stored in any of a DISK 100*e*, the RAM 600*c*, and the ROM 600*d*, can be read out, or the input image data can be input from the NIC 600*f*. The image processing function executed by the CPU 600*b* can be provided, for example, in the form of a software package, specifically, an information recording medium such a CD- ROM or a magnetic disk. Therefore, in the example shown in FIG. 22, a not-shown medium driving apparatus is provided, which, when the information recording medium is set, drives the information recording medium.

As above, the color adjusting method (image processing method) in the present invention can be performed even by an apparatus configuration that causes a general computer system that includes a display and the like to read a program recorded in the information recording medium such as a CD-ROM and causes a central processing unit of this general computer system to execute the color adjusting process (image processing). In this case, the program for executing the color adjusting process (image processing) in the present invention, i.e., the program used in a hardware system is provided in a state being recorded in a recording medium. The information recording medium in which the program or the like is recorded is not limited to a CD-ROM, and for example, a ROM, a RAM, a flash memory, and a magneto-optical disk. The program recorded in the recording medium can realize the image processing function by installing the program in a storage device incorporated in the hardware system, for example, the hard disk 600*e* so as to execute this program. Moreover, the program for realizing the functions and the like of the above embodiments can be provided from a server by a communication via a network.

According to the present invention, it is possible to avoid increase of a load at a time of document creation and avoid limitation of a degree of freedom in design.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image processing apparatus, comprising:

a color converting unit converting input image data into image forming data used for image formation;

a control unit, via implemented using a processor to control the image formation by the image forming data, wherein the color converting unit converts each of a plurality of set colors that are difficult for colorblind people to mutually distinguish among colors included in a color space of the input image data, as difficult colors for colorblind people, into a same color in a color space of the image forming data, while an ordinary color-vision person can recognize the difficult colors in the image forming data; and an output-form designating unit receiving printing modes that includes a normal printing mode and a color-scheme warning printing mode, wherein when the color-scheme warning printing mode is selected, the output-form designating unit displays on a display device a notification that an image simulating a view of the colorblind people is to be printed and displays a message that represents an oral explanation by pointing to a portion in which the color difference cannot be recognized.

2. The image processing apparatus according to claim 1, further comprising:

a storage unit storing a conversion table that corresponds a color in the color space of the input image data to a color in the color space of the image forming data and that corresponds the difficult colors for colorblind people to a set specific color, wherein the color converting unit converts the input image data into the image forming data by using the conversion table stored in the storage unit.

3. The image processing apparatus according to claim 1, wherein the color converting unit converts each of the difficult colors for each type of color vision properties of the colorblind people into each same color that is determined as same for each type of color vision properties of the colorblind people, and the control unit controls each of the image formation for each type of color vision properties based on each converted image data converted by the color converting unit for each type of color vision properties.

4. The image processing apparatus according to claim 3, wherein the color converting unit converts pixels, which are converted into same color by using at least one of each of the image formation for each type of color vision properties, into a set color so as to generate synthetic image data, and the control unit controls output of the synthetic image data.

5. The image processing apparatus according to claim 1, further comprising:

a storage unit storing a conversion table that corresponds a color in the color space of the input image data to a color in the color space of the image forming data, wherein the color converting unit converts the input image data into the image forming data by using the conversion table, and further calculates a color difference of a color between pixels that are mutually adjacent to each other in the image forming data by a set evaluation equation and, when calculated color difference is smaller than a threshold, converts each of a plurality of pixels, whose color difference is smaller than the threshold, into a set color.

6. The image processing apparatus according to claim 1, wherein the color converting unit converts each of a plurality of difficult colors for the colorblind people in the color space of the input image data into any one of a plurality of corresponding colors in the color space of the image forming data.

7. The image processing apparatus according to claim 1, wherein the color converting unit converts each of the plurality of difficult colors for the colorblind people in the color space of the input image data into a black color of the color space of the image forming data.

8. The image processing apparatus according to claim 1, further comprising a notifying unit notifying that a plurality of difficult colors in the color space of the input image data are converted into same color of the color space of the image forming data.

9. The image processing apparatus according to claim 1, wherein the notifying unit prints outs a message on a paper medium.

10. The image processing apparatus according to claim 1, wherein the color converting unit includes a first color-signal converting unit, a second color-signal converting unit, a third color-signal converting unit, and a fourth color-signal converting unit, to convert a RGB value into a CMY value.

11. The image processing apparatus according to claim 10, further comprising a synthesizing unit to synthesize an output of the second color-signal converting unit and an output of the third color-signal converting unit so as to make image forming data.

12. The image processing apparatus according to claim 11, wherein the synthesizing unit compares the CMY value of a first pixel of a P-type simulated image with a second pixel of a P-type simulated image, and concurrently compares a first pixel of a D-type simulated image with a second pixel of a D-type simulated image.

13. The image processing apparatus according to claim 12, wherein when the first pixel and the second pixel match in any of the P-type simulated image and the D-type simulated image, the synthesizing unit sets a second pixel of a newly synthesized image to the CMY value of the first pixel of the P-type simulated image.

14. The image processing apparatus according to claim 12, wherein when the first pixel and the second pixel do not match, the synthesizing unit sets the second pixel of the synthetic image data to the CMY value of the second pixel of the P-type simulated image.

15. The image processing apparatus according to claim 1, further comprising:

a color-signal replacing unit replacing colors, which are easily confused by the colorblind people, in the image data after the conversion by the color converting unit with the same color; and a color inverse conversion unit converting the image data after being replaced by the color-signal replacing unit into the image forming data for the image formation of an output device.

16. The image processing apparatus according to claim 15, wherein the color-signal replacing unit further includes:

a color-difference evaluating unit to evaluate and extract a combination of colors in an image that are easily confused by the colorblind people, and a color replacing unit to replace the colors that are easily confused with the same color and send the replaced image data to the color inverse conversion unit.

17. The image processing apparatus according to claim 1, further comprising:

a color extracting unit extracting information on colors that are used for filling with the same color from the input image data;

an area evaluating unit calculating area of regions filled with the same color that are extracted by the color extracting unit;

a color-signal converting unit converting use colors of the input image data extracted by the color extracting unit into intermediate color signals for performing a discrimination evaluation or a color adjustment;

a use-color classifying unit classifying the use colors into a plurality of groups in accordance with a value of a set color component of the use colors converted into the intermediate color signals;

a discrimination evaluating unit evaluating the discrimination between the use colors for each group classified by the use-color classifying unit; and a color adjusting unit performing the color adjustment to improve the discrimination on the use colors of the input image data in accordance with a discrimination determination result.

18. An image processing method comprising:

color-converting, via a color converting unit, that converts input image data into image forming data used for image formation; and controlling, via a control unit, the image formation by the image forming data, wherein the color-converting includes converting each of a plurality of set colors that are difficult for colorblind people to mutually distinguish among colors included in a color space of the input image data, as difficult colors for colorblind people, into a same color in a color space of the image forming data, while an ordinary color-vision person can recognize the difficult colors in the image forming data; and selecting printing modes, via an output-form designating unit, that includes a normal printing mode and a color-scheme warning printing mode, wherein when the color-scheme warning printing mode is selected, the output-form designating unit displays on a display device a notification that an image simulating a view of the colorblind people is to be printed and displays a message that represents an oral explanation by pointing to a portion in which the color difference cannot be recognized.

19. The image processing method according to claim 18, further comprising:

storing, via a storage unit, a conversion table:

that corresponds a color in the color space of the input image data to a color in the color space of the image forming data, and that corresponds the difficult colors for colorblind people to a set specific color, wherein the conversion of the input image data into the image forming data by using the conversion table is stored in the storage unit.

20. The image processing method according to claim 18, wherein the conversion of each of the difficult colors for each type of color vision properties of the colorblind people into each same color that is determined as same for each type of color vision properties of the colorblind people, and the control unit controls each of the image formation for each type of color vision properties based on each converted image data converted by the color converting unit for each type of color vision properties.

21. The image processing method according to claim 20, wherein the color converting unit converts pixels, which are converted into same color by using at least one of each of the image formation for each type of color vision properties, into a set color so as to generate synthetic image data, and the control unit controls output of the synthetic image data.

22. The image processing method according to claim 18, further comprising:

storing, via a storage unit, a conversion table that corresponds a color in the color space of the input image data to a color in the color space of the image forming data, wherein the color converting unit converts the input image data into the image forming data by using the conversion table, and further calculates a color difference of a color between pixels that are mutually adjacent to each other in the image forming data by a set evaluation equation and, when calculated color difference is smaller than a threshold, converts each of a plurality of pixels, whose color difference is smaller than the threshold, into a set color.

23. The image processing method according to claim 18, wherein the color converting unit converts each of a plurality of difficult colors for the colorblind people in the color space of the input image data into any one of a plurality of corresponding colors in the color space of the image forming data.

24. The image processing method according to claim 18, wherein the color converting unit converts each of the plurality of difficult colors for the colorblind people in the color space of the input image data into a black color of the color space of the image forming data.

25. The image processing method according to claim 18, further comprising notifying, via a notifying unit, that a plurality of difficult colors in the color space of the input image data are converted into same color of the color space of the image forming data.

26. The image processing method according to claim 25, wherein the notifying unit prints outs a message on a paper medium.

27. The image processing method according to claim 18, wherein the color converting unit includes a first color-signal converting unit, a second color-signal converting unit, a third color-signal converting unit, and a fourth color-signal converting unit, to convert a RGB value into a CMY value.

28. The image processing method according to claim 27, further comprising:

synthesize, via a synthesizing unit, to an output of the second color-signal converting unit and outputting, via an output of the third color-signal converting unit, so as to make image forming data.

29. The image processing method according to claim 27, wherein the synthesizing unit compares the CMY value of a first pixel of a P-type simulated image with a second pixel of a P-type simulated image, and concurrently compares a first pixel of a D-type simulated image with a second pixel of a D-type simulated image.

30. The image processing method according to claim 29, wherein when the first pixel and the second pixel match in any of the P-type simulated image and the D-type simulated image, the synthesizing unit sets a second pixel of a newly synthesized image to the CMY value of the first pixel of the P-type simulated image.

31. The image processing method according to claim 29, wherein when the first pixel and the second pixel do not match, the synthesizing unit sets the second pixel of the synthetic image data to the CMY value of the second pixel of the P-type simulated image.

32. The image processing method according to claim 18, further comprising:

replacing colors, via a color-signal replacing unit, which are easily confused by the colorblind people, in the image data after the conversion by the color converting unit with the same color; and converting, via a color inverse conversion unit, the image data after being replaced by the color-signal replacing unit into the image forming data for the image formation of an output device.

33. The image processing method according to claim 32, wherein replacing the colors in the image data after the conversion by the color converting unit with the same color further includes:

evaluating and extracting, via a color-difference evaluating unit, a combination of colors in an image that are easily confused by the colorblind people, and replacing, via a color replacing unit, the colors that are easily confused with the same color and send the replaced image data to the color inverse conversion unit.

34. The image processing method according to claim 18, further comprising:

extracting, via a color extracting unit, information on colors that are used for filling with the same color from the input image data;

calculating, via an area evaluating unit, area of regions filled with the same color that are extracted by the color extracting unit;

converting, via a color-signal converting unit, use colors of the input image data extracted by the color extracting unit into intermediate color signals for performing a discrimination evaluation or a color adjustment;

classifying, via a use-color classifying unit, the use colors into a plurality of groups in accordance with a value of a set color component of the use colors converted into the intermediate color signals;

evaluating, via a discrimination evaluating unit, the discrimination between the use colors for each group classified by the use-color classifying unit; and performing, via a color adjusting unit, the color adjustment to improve the discrimination on the use colors of the input image data in accordance with a discrimination determination result.

35. A non-transitory computer-usable medium having computer-readable program codes embodied in the medium for processing information in an information processing apparatus, the program codes when executed causing a computer to execute;

color-converting that converts input image data into image forming data used for image formation; and controlling the image formation by the image forming data, wherein the color-converting includes converting each of a plurality of set colors that are difficult for colorblind people to mutually distinguish among colors included in a color space of the input image data, as difficult colors for colorblind people, into a same color in a color space of the image forming data, while an ordinary color-vision person can recognize the difficult colors in the image forming data; and selecting printing modes, via an output-form designating unit, that includes a normal printing mode and a color-scheme warning printing mode, wherein when the color-scheme warning printing mode is selected, the output-form designating unit displays on a display device a notification that an image simulating a view of the colorblind people is to be printed and displays a message that represents an oral explanation by pointing to a portion in which the color difference cannot be recognized.

* * * * *